US005440878A

United States Patent [19]

Gleasman et al.

[11] Patent Number: 5,440,878

[45] Date of Patent: Aug. 15, 1995

[54] VARIABLE HYDRAULIC MACHINE

[75] Inventors: Vernon E. Gleasman, 11 Pondview Dr., Pittsford, N.Y. 14534; Keith E. Gleasman, 11 McCoord Woods, Fairport, N.Y. 14450; Arthur H. McElroy, II, Tulsa; David W. Porter, Broken Arrow, both of Okla.

[73] Assignees: Vernon E. Gleasman, Pittsford; Keith E. Gleasman, Fairport, both of N.Y.

[21] Appl. No.: 936,842

[22] Filed: Aug. 27, 1992

[51] Int. Cl.[6] ..... F16D 39/00

[52] U.S. Cl. ..... 60/487; 91/485; 91/506; 60/456

[58] Field of Search ..... 60/487, 489, 437, 456; 74/60; 91/476, 478, 480, 494, 504, 505, 506, 485

[56] References Cited

U.S. PATENT DOCUMENTS

| | | | |
|---|---|---|---|
| 570,528 | 11/1896 | Wyeth . | |
| 715,725 | 12/1902 | Worron et al. | 91/478 |
| 1,112,054 | 9/1914 | Clawson . | |
| 1,379,492 | 5/1921 | Wagner . | |
| 1,910,054 | 5/1933 | Rayburn | 91/505 |
| 2,256,079 | 9/1941 | Dinzl | 92/12.2 |
| 2,315,076 | 3/1943 | Orshansky et al. | 91/480 |
| 2,374,595 | 4/1945 | Franz . | |
| 2,389,374 | 11/1945 | Levy . | |
| 2,392,980 | 1/1946 | Fawkes . | |
| 2,429,578 | 10/1947 | Gleasman . | |
| 2,436,797 | 3/1948 | Deschamps et al. . | |
| 2,573,792 | 11/1951 | Jakobsen . | |
| 2,598,538 | 5/1952 | Haynes . | |
| 2,633,802 | 4/1953 | Parilla et al. . | |
| 2,645,901 | 7/1953 | Elkins . | |
| 2,667,862 | 2/1954 | Muller . | |
| 2,737,894 | 3/1956 | Ferris | 91/506 |
| 2,817,250 | 12/1957 | Forster . | |
| 2,941,480 | 6/1960 | Sadler et al. . | |
| 3,208,222 | 9/1965 | Wilmes | 60/464 |
| 3,249,052 | 5/1966 | Karlak . | |
| 3,299,829 | 1/1967 | Jackson et al. . | |
| 3,304,885 | 2/1967 | Orth | 60/456 |
| 3,319,874 | 5/1967 | Welsh et al. . | |
| 3,360,933 | 1/1968 | Swanson et al. | 60/464 |
| 3,498,227 | 3/1970 | Kita | 91/490 |
| 3,507,584 | 4/1970 | Robbins, Jr. . | |
| 3,680,312 | 8/1972 | Forster . | |
| 3,702,143 | 11/1972 | Van Wagenen et al. | 137/625.21 |
| 3,704,588 | 12/1972 | Trabbic . | |
| 3,823,557 | 7/1974 | VanWagenen et al. | 60/327 |
| 3,873,240 | 3/1975 | Leduc et al. . | |
| 4,037,993 | 7/1977 | Roberts . | |
| 4,188,859 | 2/1980 | VanWagenen et al. | 60/487 |
| 4,215,545 | 8/1980 | Morello et al. | 60/437 |

(List continued on next page.)

FOREIGN PATENT DOCUMENTS

| | | | |
|---|---|---|---|
| 692148 | 5/1953 | United Kingdom | 74/60 |
| 707254 | 4/1954 | United Kingdom | 91/480 |

*Primary Examiner*—F. Daniel Lopez
*Attorney, Agent, or Firm*—Eugene Stephens & Associates

[57] ABSTRACT

A hydraulic machine is disclosed in several embodiments as a pump, as a motor, and as a combination pump/motor. The machine's fixed cylinders are positioned circumferentially to a drive shaft, the pistons being driven by, or acting against, a split swash-plate which is supported primarily by the same main bearing in which the drive shaft rotates. The inclination of the split swash-plate is adjusted by an axially-movable servo mechanism which is also arranged circumferentially to the drive shaft. Preferred embodiments include, among other features, (i) various gimballed-yoke supports for the non-rotating portion of the swash-plate, (ii) various designs for a rotating valve-plate, and (iii) a radial valve system. The unique arrangement of elements provides a machine that is remarkably compact and lightweight, being (a) significantly smaller than commercially-available machines having similar horsepower ratings and (b) operable hydrodynamically (i.e., at constant horsepower) at reduced speeds. In one preferred embodiment, pump and motor units are mounted side-by-side within a combined housing having integrated fluid passageways for transferring operating fluid between the units, and the combined housing itself is mounted within a surrounding reservoir.

26 Claims, 16 Drawing Sheets

U.S. PATENT DOCUMENTS 4,301,716 11/1981 Saegusa et al. .
4,433,596 2/1984 Scalzo ..... 91/506
4,495,855 1/1985 Murikami et al. .
4,506,648 3/1985 Roberts .
4,520,712 6/1985 Hovorka et al. ..... 91/505
4,526,516 7/1985 Swain et al. .
4,543,043 9/1985 Roberts .
4,712,982 12/1987 Inagaki et al. .
4,735,050 4/1988 Hayashi et al. .
4,801,248 1/1989 Tojo et al. .
4,815,358 3/1989 Smith .
4,856,279 8/1989 Kawahara et al. ..... 60/489
4,916,901 4/1990 Hayashi et al. .
4,979,877 12/1990 Shimizu .
5,054,289 10/1991 Nagatomo ..... 60/489

VARIABLE HYDRAULIC MACHINE

TECHNICAL FIELD

The invention relates to hydraulic pump/motor machines of the type used in automotive, machine tool, and manufacturing industries.

BACKGROUND OF INVENTION

Hydraulic pumps and motors are well known and widely used, being one of the basic prime movers utilized by all industrial societies. These hydraulic machines are used in many different types of automotive vehicles, construction apparatus, machine tools, and manufacturing processes; and they come in all sizes, ranging from small displacement units (less than 1.2 cu.in.) to very large units (displacing more than 15 cu.in. of fluid per revolution). Among the small units are very high-speed/high-pressure devices that are only used for relatively low horsepower requirements, e.g., moving the ailerons of aircraft, positioning controls for machinery, etc.; and the large end of the range includes very low-speed/high-torque units used to operate earth movers, backhoes, etc. Many of these pump/motors have variable displacement capabilities, and the invention herein has particular relevance to such variable units which are capable of displacing more than 1.0 cu.in. per revolution. While the commercially-available pump/motors of this latter type are capable of withstanding pressures as high as 6,000 psi, structural design limitations make them generally incapable of attaining speeds over 4,000 rpm.

Further, all commercially-available variable pump-/motors of which we are aware are of hydrostatic design. (Note: As used herein, the term "hydrostatic" is used to identify machines which deliver generally constant torque; and, in contrast, the term "hydrodynamic" is used to identify hydraulic machines capable of delivering generally constant horsepower.) For reasons that will be more fully explained below, the efficiency of hydrostatic pumps decreases inversely with the speed of operation, i.e., such pump/motors are only fully efficient when run at their top operational speeds. However, for most uses, it would be desirable to have pump-/motors which remain efficient over a variable range of speed and torque requirements, e.g., to satisfy the continuous hydraulic power requirements of automotive transmissions.

This inefficiency problem persists in spite of the fact that the design of hydraulic pumps is an old and well-developed art. All types of pump elements relating to every aspect of pump design are well known. Prior art patents show hundreds of designs for cylinders and pistons; and, for controlling the intake and exhaust of fluid from the cylinders, they show numerous types of ball valves, spring check valves, shuttle valves, valve-plates, etc. Similarly, various designs for both fixed and variable-angle swash-plates have been disclosed for many decades in patent references; and these include split designs having a non-rotating-but-nutating portion coupled with a second portion that both rotates and nutates, the patent art showing such swash-plates being connected to drive shafts by bolts, T-bars, sliding guides, etc. Also, this same patent prior art discloses a wide variety of apparatus for controlling the adjustment of such variable swash-plates, e.g., screw threads, inclined planes, hydraulic servo mechanisms, etc.

However, in spite of all of this well-developed prior art, and in spite of the clearly indicated need for a commercially-satisfactory hydrodynamic pump (e.g., for use with vehicle transmissions), no one has created such a pump. That is, no one has been able to combine the elements of a variable swash-plate machine in a commercially-feasible structure that can satisfactorily perform under the wide range of pressures and speeds necessary for hydrodynamic operation.

While there are hundreds of patented pump designs in this old and developed art, most of these have apparently never proved successful in the marketplace. Therefore, the remaining portion of this background section will discuss only pump designs that are presently available commercially. Further, in order to facilitate appreciation of the significant improvement provided by the invention herein, the following discussion of commercially-available prior art will be generally limited to medium-sized pump units which are appropriate for a wide variety of automotive and industrial uses; and, for purposes of comparison, performance specifications will only be quoted for such pumps having generally similar displacements (approximately 4 cu.in.).

It is common for such medium-sized pump/motors to operate with maximum speeds around 3,000 rpm and maximum pressures of about 3,000–6,000 psi. While these medium hydraulic pressures can usually be contained appropriately in a relatively easy manner, containment becomes a significant problem for higher pressures, except in those few instances where other design limitations do not prevent an appropriate change in the weight or size of the hydraulic units to assure needed strength for safety or efficient sealing.

However, most industrial uses do have such design limitations. Size is particularly limited in the automotive industry where every extra pound reduces automotive efficiency and where space is at a premium. However, even in those instances where size is not a problem (e.g., large earth-moving equipment), operating pressures are limited due to cost restraints and sealing problems. Therefore, most industrial pumps are designed for maximum pressures determined by the torque requirements accompanying their desired maximum speed.

For instance, the hydraulic units used to operate vehicles are designed so that they can appropriately contain the pressures developed when the vehicle's maximum available input horsepower is applied at the pump's highest operating speed, namely, when it is being rotated 1:1 with the vehicle's engine.

Industrial pumps are similarly designed to safely contain the maximum pressures developed when the pump is delivering full horsepower at its highest specified speed. However, as the speed of such a pump is reduced and the same maximum horsepower is applied to the pump's input, the pressures within the pump increase proportionally to its reduction in speed. Since the units are designed only for the maximum pressures developed at top speed, the pressure increases developed at lower speeds must be bled off to avoid exceeding the top-speed pressure limit. This bleed-off of pressure represents lost efficiency. For example, assume that a pump is designed for a maximum pressure of 6,000 psi when providing 100 hp at a top speed of 2,400 rpm. When the pump is operated at one-quarter speed (600 rpm), its torque must be maintained, by necessity, at the limit of 6,000 psi. Therefore, at one-quarter speed, this hydrostatic unit can provide no more than 25 hp, i.e., its maximum power output at this lower speed is limited to only one-quarter of its available input power.

Mechanical drives are not so limited: In contrast, when power is supplied through a mechanical drive and a gear reduction box, the full input horsepower can be supplied at all reduced speeds; and therefore, when the speed of the mechanical drive is reduced by a 4:1 gear ratio, at one-quarter speed it provides a torque that is four times greater. Comparing this with the prior art hydrostatic device just referred to above, in order for the latter to provide the same 100 hp at one-quarter speed, the torque would have to be increased to 24,000 psi. The inability of presently-available, medium-sized hydraulic machines to operate appropriately under such pressures severely limits their efficiency. (Of course, as an alternative, it would be possible to replace the medium-sized unit with one having four times as much displacement; but such a larger hydraulic unit would cost much more, would be much larger, and would weigh more than twice as much.)

Therefore, presently-available constant-torque pump-/motors are often associated with mechanical gear boxes which mechanically reduce the rotational speed of the output while maintaining the hydraulic drive at more efficient higher speeds. Although there are many power needs that could be more effectively met by full-range hydraulic machines, presently-available designs cannot produce full horsepower throughout a full range of desired rotational speeds and/or within desired limitations of size and weight.

Commercially-available hydraulic machines come in one of two basic design formats. In the most commonly used design, the pump's cylinder block rotates; and the pistons of its rotating cylinders are reciprocated as pivoting "shoes", which are attached to the end of each piston, slide over the surface of an adjustable-angle swash-plate. For controlling the flow of pressurized fluid in prior art pumps of this first basic design, the end-ports of the rotating cylinders sweep over a valve-plate, and the cylinder block must be very heavily biased against the valve-plate to minimize blowby. Therefore, the shoes and valve-plates must be regularly replaced to prevent excessive blowby and an accompanying loss in volumetric efficiency.

Further, with pumps of this first basic prior art format, as cylinder bore size is increased to meet higher power requirements, the weight and radius of the spinning cylinder blocks must necessarily be increased. This, of course, results in a proportional increase in centrifugal forces acting on the rotating cylinder blocks and pistons, placing fairly severe limits on rotational speeds. For instance, in addition to requiring more massive support structure, these increased centrifugal forces also cause the outside of the rotating piston-end shoes to lift off the surface of the swash-plate and force the extended pistons out of alignment with the cylinders, resulting in increased blowby.

Still another problem affects this first basic prior art design. Namely, the spinning cylinder blocks rotate in fluid-filled chambers; and, as speed is increased, such pumps become more inefficient due to power losses which result as their spinning cylinders move through oil. This churning of the oil increases its temperature, requiring the use of large oil reservoirs and often heat exchangers or coolers to reduce the temperature of the oil.

Because of these just-mentioned problems, it has long been recognized in the industry that it would be preferable to design machines in which the cylinders remain fixed in the housing and the pistons reciprocate against a rotating-and-nutating swash-plate. This latter design is used in the second commercially-available format. While hydraulic machines of this second design achieve higher pressures, their swash-plates are not adjustable. Thus, when used in pump/motor combinations, the speed of the motor is controlled by bleeding off volume and pressure from the pump's fluid output. In this regard, it has also been long recognized that such swash-plates should be angularly adjustable to provide speed control, but no one has been able to design such an angularly-adjustable device that is commercially satisfactory. Further, in a manner similar to the pumps of the first format, the fixed-angle swash-plates of this second format nutate in oil-filled chambers, resulting in similar churning, power losses, and temperature increases. Further, the fixed cylinders of these pumps cannot be filled rapidly, resulting in fairly severe restrictions on their practical operating speeds. Two such examples are a 4.6 cu.in. pump by Dynex-Rivett and a 4 cu.in. model by Oil Gear which, while capable of operating efficiently at 8,500 psi and 15,000 psi, respectively, have respective top speeds of 1,800 rpm and 2,200 rpm.

As indicated above, prior art patents disclose adjustable swash-plate designs using split swash-plates having two elements, namely, a non-rotating-but-nutating portion coupled with a second portion that both rotates and nutates. However, we are Unaware of any presently-available commercial pumps or motors using such prior art designs. This apparent lack of success may be related to the difficulty of providing an acceptable structure for supporting the non-rotating portion in a manner that prevents the collapse of the piston-connecting rods under the tangential forces that are created by the relative rotation between the split portions of the swash-plate. Many of these patented structures prevent rotation of the nutating-but-non-rotating portion by fixing it to a support system that includes a block sliding in a channel in the housing. Of course, with this type of restraining means, the mass of the block and its mounting must be reciprocated at high speeds against one side or the other of the channel, since the block must move back and forth for each nutation of the split swash-plate. Such structures have apparently been less than satisfactory.

A further problem that affects the efficiency and versatility of both of these commercially-available design formats relates to controlling the flow of fluid to and from the cylinders. To avoid blowby around the valve holes during the relative rotation between the pump/motor's cylinders and the valve-plate, the plates and cylinders of these pumps are heavily spring biased against each other, so the use of substantial mechanical force is required to overcome the static friction between these members in order to initiate pump operation. Therefore, such presently-available pump/motors are often incapable of developing meaningful operating horsepower at speeds of less than 500 rpm.

Efficiency is also lost because the fluid reservoirs of most presently-available pump/motors must often be maintained at pressures of at least 100 psi in order to assist the opening of fluid intake valves, to minimize cavitation problems and, sometimes, to assure the retraction of the pistons following each power stroke.

In addition to the inefficiencies and other problems referred to above, presently-available pump/motors are also relatively large in outside dimensions as well as relatively heavy in weight. Such big housings are needed by these prior art machines for supporting (a) the rotating swash-plates or cylinders, and, in those machines using adjustable swash-plates for controlling hydraulic output, for supporting (b) the means for adjusting the angle of the swash-plate. For example: A 4.1 cu.in. pump marketed by Eaton, specified to develop 100 hp at a maximum of 2,500 rpm and 3,500 psi, weighs 70 pounds and is 8.5" in diameter. However, this latter dimension does not include a 2"×2"×4" attachment which houses a portion of the servo mechanism that controls the angular adjustment of the swash-plate. Similarly, Volvo sells a 4 cu.in. pump (150 hp at 2,500 rpm and 6,000 psi) that weighs 132 pounds in a 7.5" diameter housing, but also has part of its servo mechanism mounted in an external attachment which extends several inches beyond the basic pump housing.

In contrast to this prior art, the novel hydraulic machine disclosed herein is a hydrodynamic device (capable of delivering constant horsepower at reduced speeds) which, for example, with a 4.4 cu.in. displacement, can provide 456 hp at 5,000 rpm and 4,000 psi. Further, these just-stated specifications can be achieved by one of our hydraulic units that weighs only 30 pounds and is contained within a housing that is only 4.875" in diameter, and that latter dimension includes the servo mechanism which controls the swash-plate.

SUMMARY OF THE INVENTION

Our invention is a unique combination of well-known mechanical elements organized and mounted in a novel manner to provide a hydraulic pump/motor machine capable of operating at improved maximum speeds and pressures while, at the same time, being remarkably reduced in size and weight. The invention, which is disclosed in several embodiments, comprises an exceptionally compact reciprocating-piston pump unit capable of developing much higher horsepower than any known pump of similar size while running at high speeds and also capable of withstanding the high pressures necessary to develop the same higher horsepower at lower speeds.

The pump's cylinders, which do not rotate, are fixed in a cylindrical housing circumferentially about a central axis; and the nutating motion of a split swash-plate reciprocates its axial pistons. The specially mounted split swash-plate has a first portion which nutates but does not rotate, and a second portion which both nutates and rotates, the second portion being connected by means of a toggle-link with a drive element that is aligned with the pump's central axis. The drive element is supported in a main bearing positioned at one end of the housing. The main bearing is designed as a replaceable cartridge which can be varied in accordance with the loads for which the unit is designed.

To vary the stroke of the pistons, the swash-plate is pivoted on a T-bar carried on a linearly-adjustable slideable shaft that is positioned concentric with the drive element, one end of the slideable shaft being splined to the drive element and the other end of the slideable shaft being supported in a movable bearing carried by a servo mechanism. The T-bar pivot is movable by the servo mechanism to any one of a plurality of locations between (a) a first location where the swash-plate is at a minimum inclination (e.g., 0°) in which it does not nutate and the pistons do not reciprocate and (b) a final location where the swash-plate is at a maximum inclination (e.g., 30°) and the pistons are reciprocated through a maximum stroke in response to the nutation of the swash-plate.

The support structure for the split swash-plate and its pivot includes the specially designed toggle-link arrangement that connects the rotating portion of the split swash-plate with the drive shaft at a location close to the axis of the drive shaft selected so that a larger percentage of the operating forces exerted on the swash-plate are borne by the machine's main bearing rather than by the T-bar pivot and the movable bearing. By this reduction of the loads carried by the movable bearing, the inclination of the swash-plate is readily adjustable by the servo mechanism under all operating conditions.

The servo mechanism, which is used to control the inclination of the swash-plate, is also positioned concentric with the machine's central axis, namely, in alignment with both the slideable shaft that carries the T-bar pivot and with the drive shaft. With this arrangement, the servo mechanism lies wholly within the cylindrical machine housing, enhancing the compactness of the structure.

The non-rotating portion of the swash-plate holds one ball-shaped end of each of a plurality of connecting rods. Since the ends of the articulated connecting rods are held in ball joints, collapse of the rods relative to the swash-plate (under the tangential forces related to the relative rotation between the two portions of the split swash-plate) must be prevented. The invention maintains swash-plate/connecting rod alignment with novel restraining means which are remarkably compact and lightweight structural arrangements and which, like the main bearing, may be interchanged in a relatively easy manner in accordance with desired pump/motor specifications. For relatively low horsepower requirements, the structure is quite simple, namely, at least one of the connecting rods is merely passed through a slotted end cap positioned over the top end of its related piston so that the movement of the connecting rod relative to its piston is limited to the one plane defined by the end-cap slot. However, for increasingly higher horsepower requirements, the invention supports the nutating-but-non-rotating portion of the split swash-plate in increasingly stronger versions of a novel gimballed-yoke structure.

As just indicated above, the non-rotating portion of the swash-plate holds one end of each of a plurality of connecting rods, the other ball-shaped end of each connecting rod being held by a respective one of the pump's pistons. In one embodiment, the piston structure holding the connecting rod acts as a ball-type valve which closes on each power stroke while opening slightly as the piston is mechanically retracted following each power stroke. With this arrangement, the filling of each cylinder is supplemented by a fluid flow into each cylinder head, thereby minimizing cavitation problems.

In two embodiments, the pump's fluid inlet ports are controlled by a plurality of cylindrical shuttle valves positioned respectively within each cylinder for reciprocation between two end positions in response to the movement of the pistons. Each respective shuttle valve is positioned circumferentially to the piston of its respective cylinder so that the shuttle valve's movement away from each of its two end positions is inertially delayed relative to the movement of the piston. The shuttle valves open an inlet passage in the housing permitting the flow of fluid into the cylinders whenever the pistons are being retracted, and the shuttle valves block the inlet passage whenever the pistons are moving in the opposite direction.

Similarly, in both of the embodiments incorporating the just-described shuttle valves, during the power stroke of each pump piston, pressurized fluid exits the bottom of the cylinder through valve means specially designed to accommodate high pressures. In the first of these embodiments, the exit valve means comprise a double-walled check valve biased by a spring that is protected by the double-wall structure so that, in this manner, the spring is not in the direct flow path of the high-pressure fluid exiting the cylinder. (This check valve structure is disclosed in U.S. Pat. No. 2,429,578 issued to V. E. Gleasman.) In the second of these embodiments, the exit valve means comprises a valve-plate which rotates with the drive means and includes pressure-balancing means for preventing its lock-up.

In another preferred embodiment, the input and exit valves are replaced by valve means comprising a single rotating valve-plate with first and second sets of orifices which connect, respectively, with first and second mating ports formed in the housing. This latter embodiment is particularly appropriate for use in closed-loop systems in which the direction of fluid movement is reversed to change the direction of the motor's rotation.

In still another preferred embodiment, the rotating valve-plate is replaced by a plurality of radially-positioned valves, each valve being associated with a respective one of the cylinders. Each valve is movable between two end positions, being biased toward one end position by a spring, and being movable toward the other end position by a cam rotated by the drive means. The operation of each respective valve is arranged so that, whenever the piston in its associated cylinder is reciprocating in a first direction, the valve permits the flow of fluid between the cylinder and a first one of the mating fluid-delivery ports formed in the housing and, simultaneously, blocks the flow of fluid between the cylinder and a second one of the fluid-delivery ports in the housing. Similarly, whenever the piston is reciprocating in the opposite direction, the associated valve blocks the flow of fluid between the cylinder and the first fluid-delivery port and, simultaneously, permits the flow of fluid between the cylinder and the second fluid-delivery port.

In another important design feature, the drive shaft and the adjustable swash-plate are located in a dry sump and thus do not have to overcome any fluid resistance during operational movements. This not only reduces the power consumption of the machine, but it also greatly reduces heat buildup in the operating fluid and avoids the need for a large fluid reservoir and/or exceptional cooling.

Those skilled in the art will understand that the pump unit can also act as a motor, and the invention's basic hydraulic machine is also disclosed in embodiments particularly suitable for use as hydraulic motors. Many of the features of the motor embodiments are identical to the pump units, providing similarly compact and remarkably lightweight structural arrangements which permit the motors to develop high horsepower at high speeds while also withstanding the high pressures necessary to develop the same horsepower at lower speeds. The motor units differ from the pump embodiments referred to above in that the servo mechanism is removed and the split swash-plate is preferably fixed at the maximum inclination in which the pistons reciprocate through a maximum stroke. Also, in one embodiment, the exhaust valve means is modified to include cam-operated valves that replace the pump's check valves at the bottom of the cylinders, the cam being driven by a slideable shaft which can be adjusted to permit motor reversal. In these motor embodiments, the drive means is rotated with the rotating portion of the swash-plate when the latter is nutated by the reciprocation of the motor's pistons at a speed proportional to the volume of high-pressure fluid delivered to its cylinders.

In a further embodiment of our hydrodynamic hydraulic machine according to the invention, the pump and motor units referred to above are mounted together in similar side-by-side cylindrical housings which are joined together to form integrated fluid passageways for transferring fluid from one unit to the other. That is, the pump and motor are combined in a compact mounting arrangement within a single housing which itself is mounted within a further surrounding casing that is filled with the operating fluid for the units; and the joined housings also include further integrated fluid passageways for transferring operating fluid between the hydraulic units and the surrounding reservoir. With this novel arrangement, the side-by-side pump/motor units are surrounded by their fluid reservoir, greatly simplifying the delivery of fluid to and from the units and, at the same time, permitting the reservoir to act as both a heat sink and a sound insulator for reducing the ambient noise of the remarkably compact pump/motor machine.

In commercially-available prior art systems, the hydraulic fluid reservoirs are often charged to approximately 100 psi by small gear pumps which are operated by the same input drives that are used to rotate the system's main piston pump. In contrast, in one embodiment of our invention, a small auxiliary pump maintains a fluid pressure of about 45 psi in the fluid reservoir, and this relatively low pressure is sufficient to maintain operation of the invention's hydraulic pump unit or combined pump/motor units.

In another embodiment, a small, well-known type of gear pump is built into the motor unit for recharging the reservoir. Since this small charging pump is incorporated in the motor unit rather than in the pump unit, recharging only takes place during operation of the hydraulic motor. Therefore, such recharging Occurs only when it is needed; and when the hydraulic motor is not operating (e.g., when a hydraulically-assisted automotive transmission has reached its 1:1 operating relationship with the vehicle's engine), there is no power drain on the system to operate the charging pump.

Our novel hydraulic machine structure also includes a lubrication system which utilizes the fluid blowby as well as a small portion of the operating fluid which is pressurized by the pump. In one embodiment, pressurized lubricating fluid is provided, even when the pump is not driving its accompanying motor, by a mechanism that positions the swash-plate at a very small angle (no greater than 1°) when the swash-plate is in its minimum inclination. This permits a very minimal reciprocation of the pistons which, while not appreciably affecting the efficiency of the system, maintains sufficient pressure on the operating fluid for lubricating purposes.

DRAWINGS

FIG. 2B showing the lower piston positioned near the beginning of its pressure-generating power stroke; and both showing intake valve ports omitted in FIG. 1.

Figure 10:
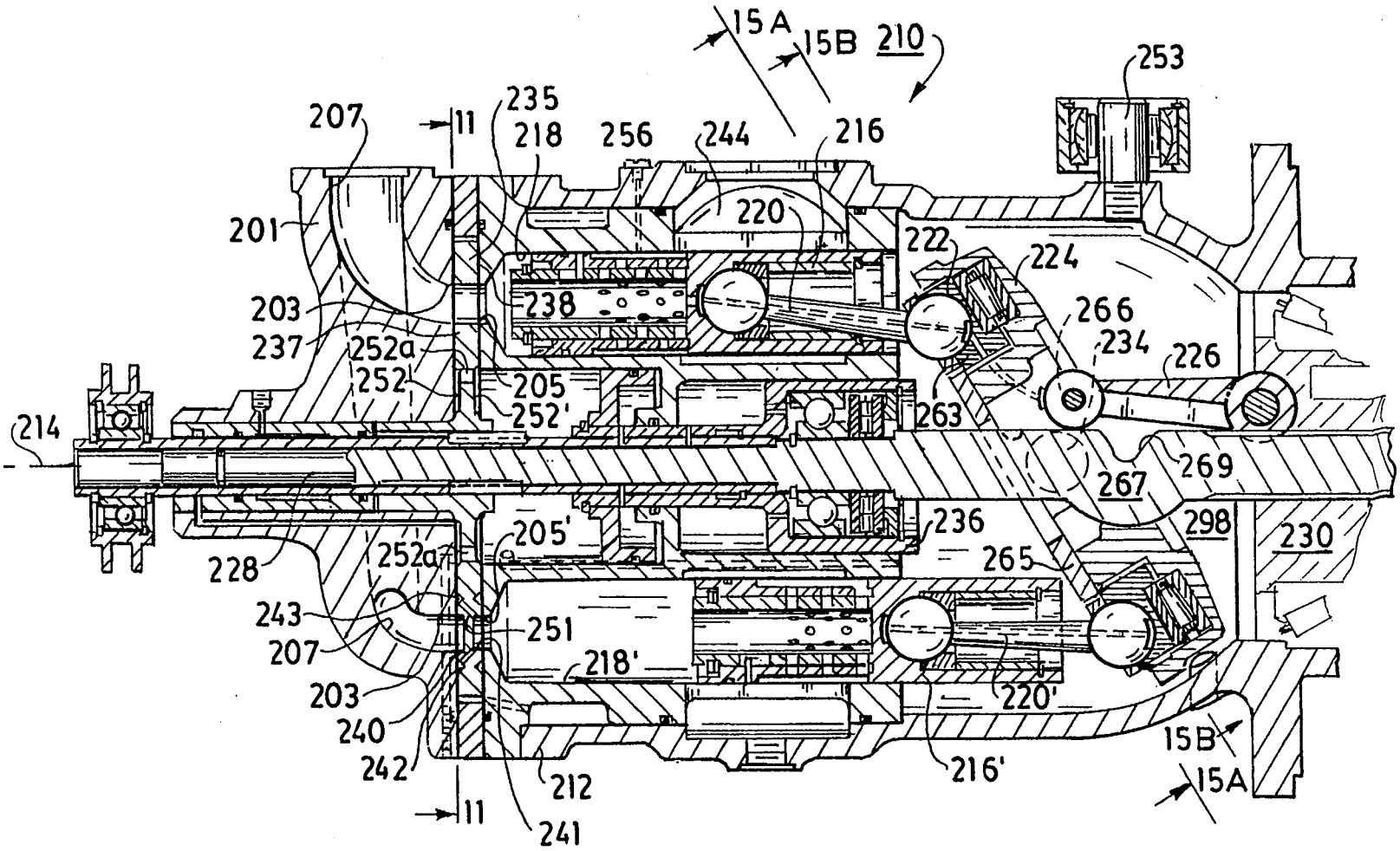
FIG. 10 is a partially schematic cross-sectional view of the swash-plate and cylinder/piston portions of another hydraulic machine embodiment of the invention.
Figure 12:
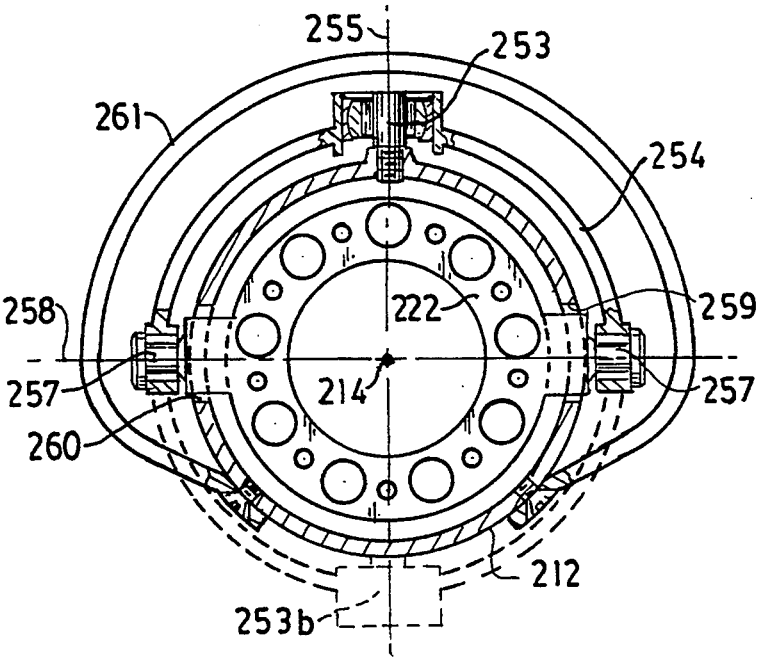
FIG. 12 is a schematic cross-sectional view of the casing and the gimballed-yoke structure used to support the nutating-but-non-rotating portion of the split swash-plate of the machine shown in FIG. 10, the dotted lines showing a further modification appropriate for motor versions of the machine.
Figure 14A:
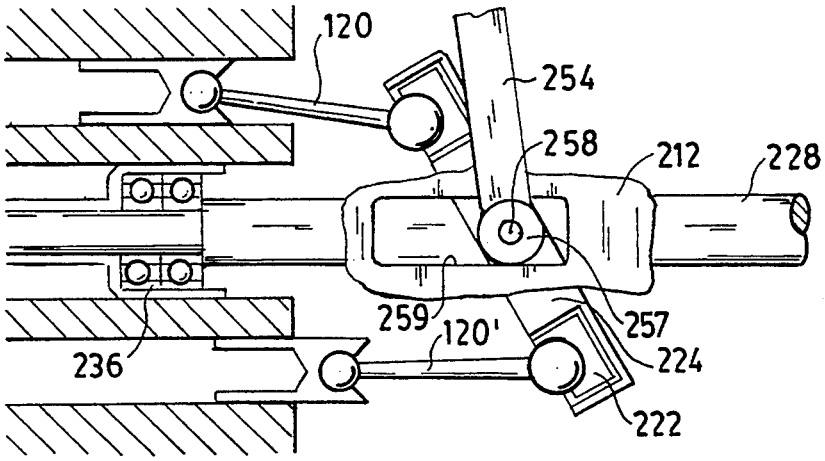
Figure 14B:
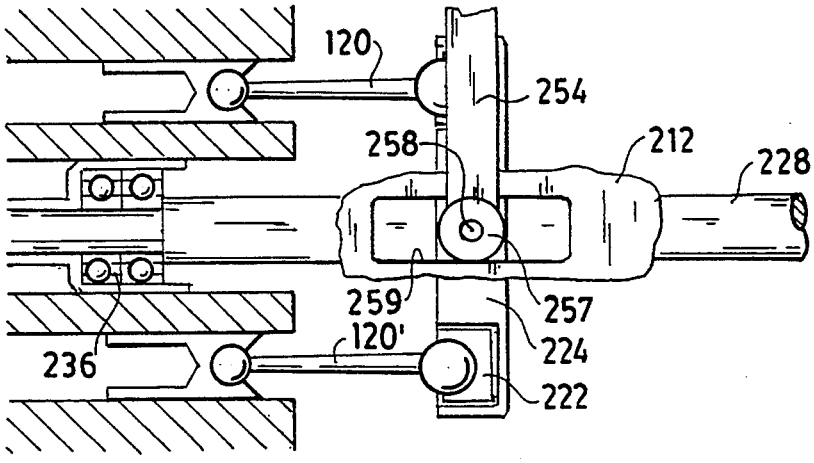
Figure 14C:
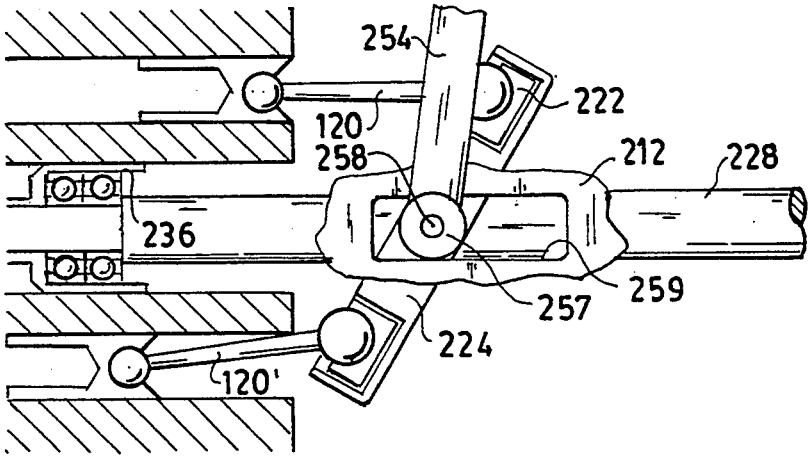

FIGS. 14A, 14B, and 14C are schematic representations of the swash-plate/movable bearing portion of the machine of FIG. 10, showing the relationship between a portion of the outer yoke of the gimballed-yoke structure of FIG. 12 and the housing of the pump when the swash-plate is inclined at three different angles.

Figure 15A:
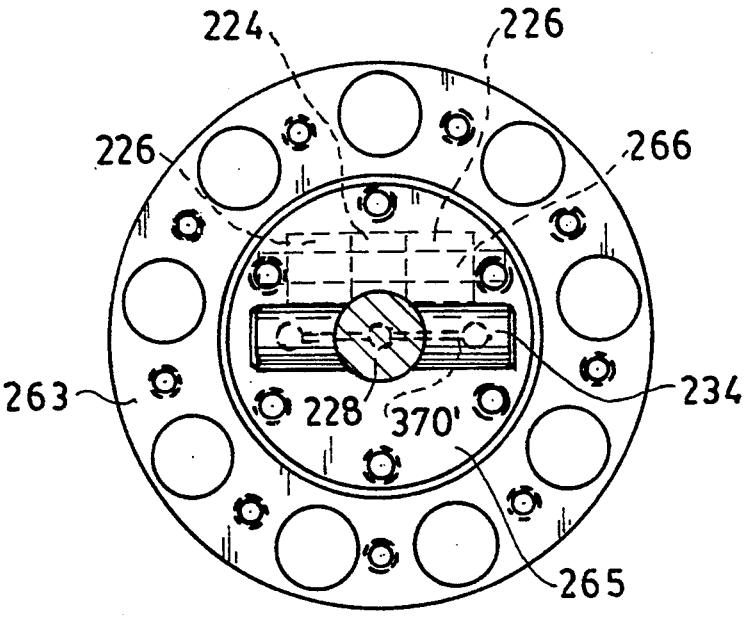
Figure 15B:
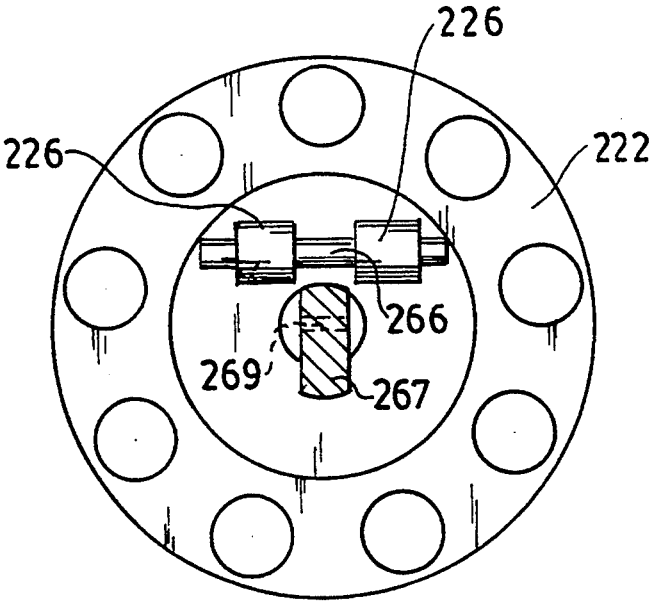

FIGS. 15A and 15B are partial views of the swash-plate, drive shaft, T-bar pivot, and toggle-link portions of the machine of FIG. 10, taken generally along lines 15A—15A and 15B—15B, respectively.

Figure 16:
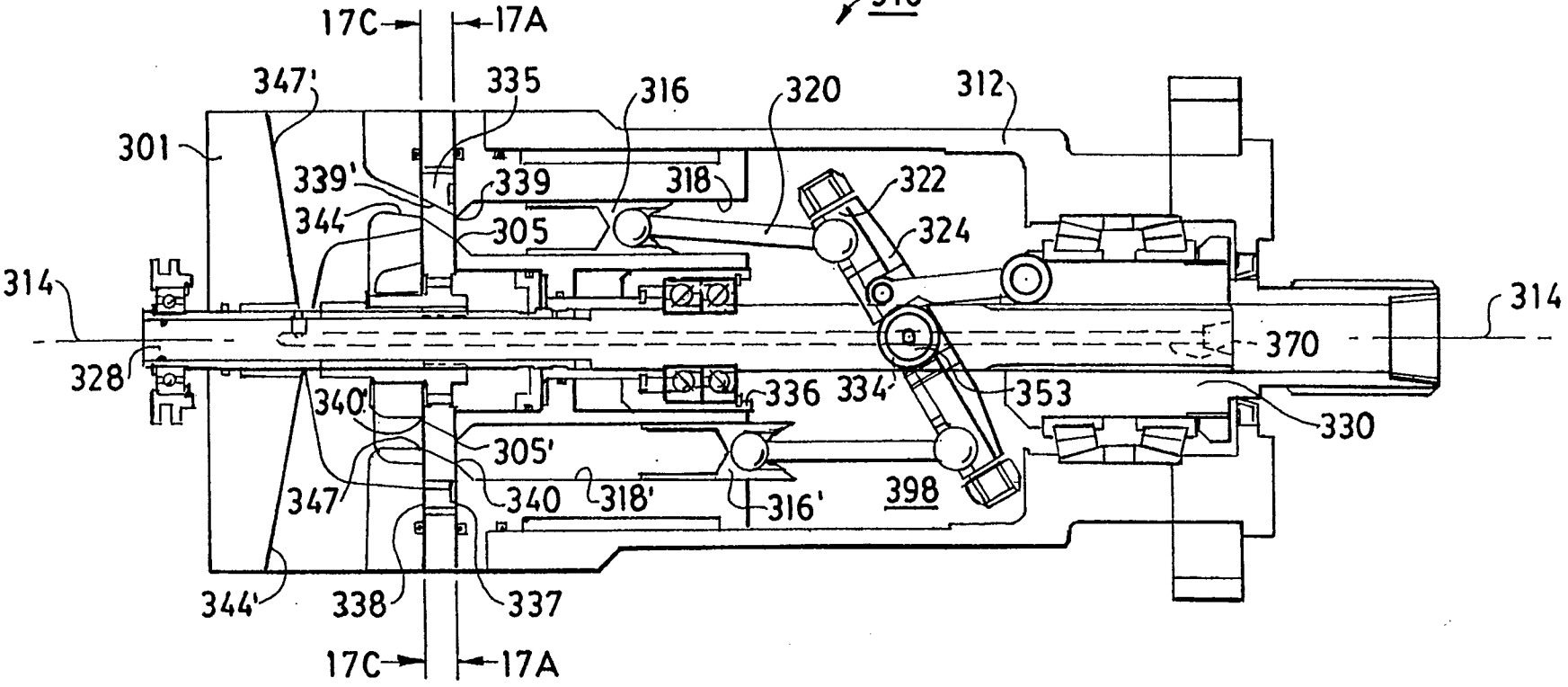

FIG. 16 is a schematic cross-sectional view of a further embodiment of the invention as a hydraulic pump.

Figure 17A:
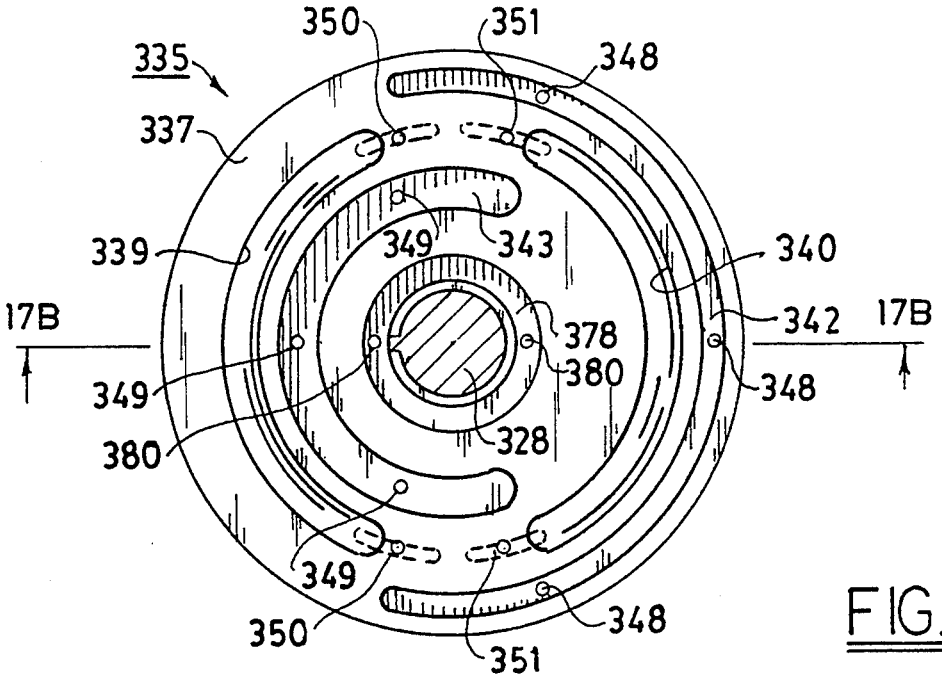
Figure 17B:
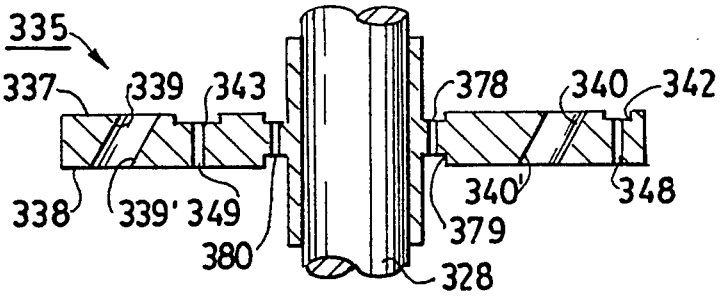
Figure 17C:
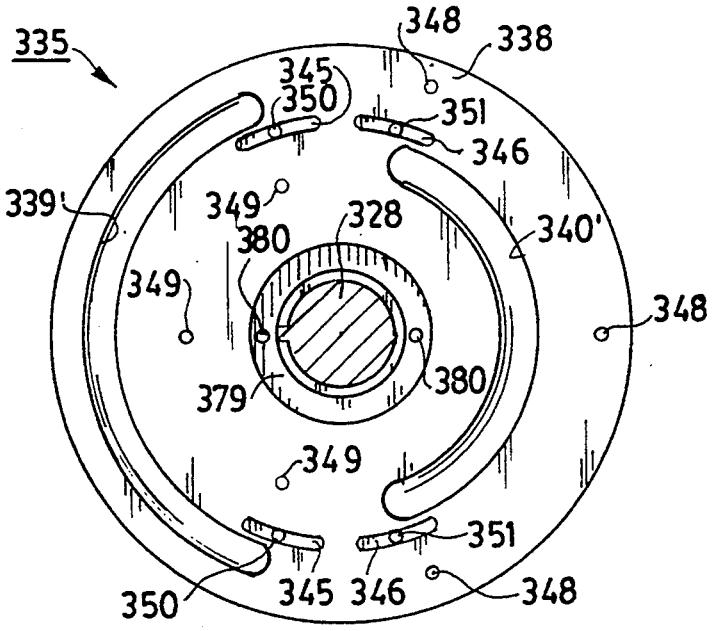

FIGS. 17A, 17B, and 17C are three views of the disk-shaped valve-plate used in the embodiment shown in FIG. 16, FIGS. 17A and 17C being end views taken along planes 17A—17A and 17C—17C, respectively; and FIG. 17B being a cross-sectional view.

Figure 18:
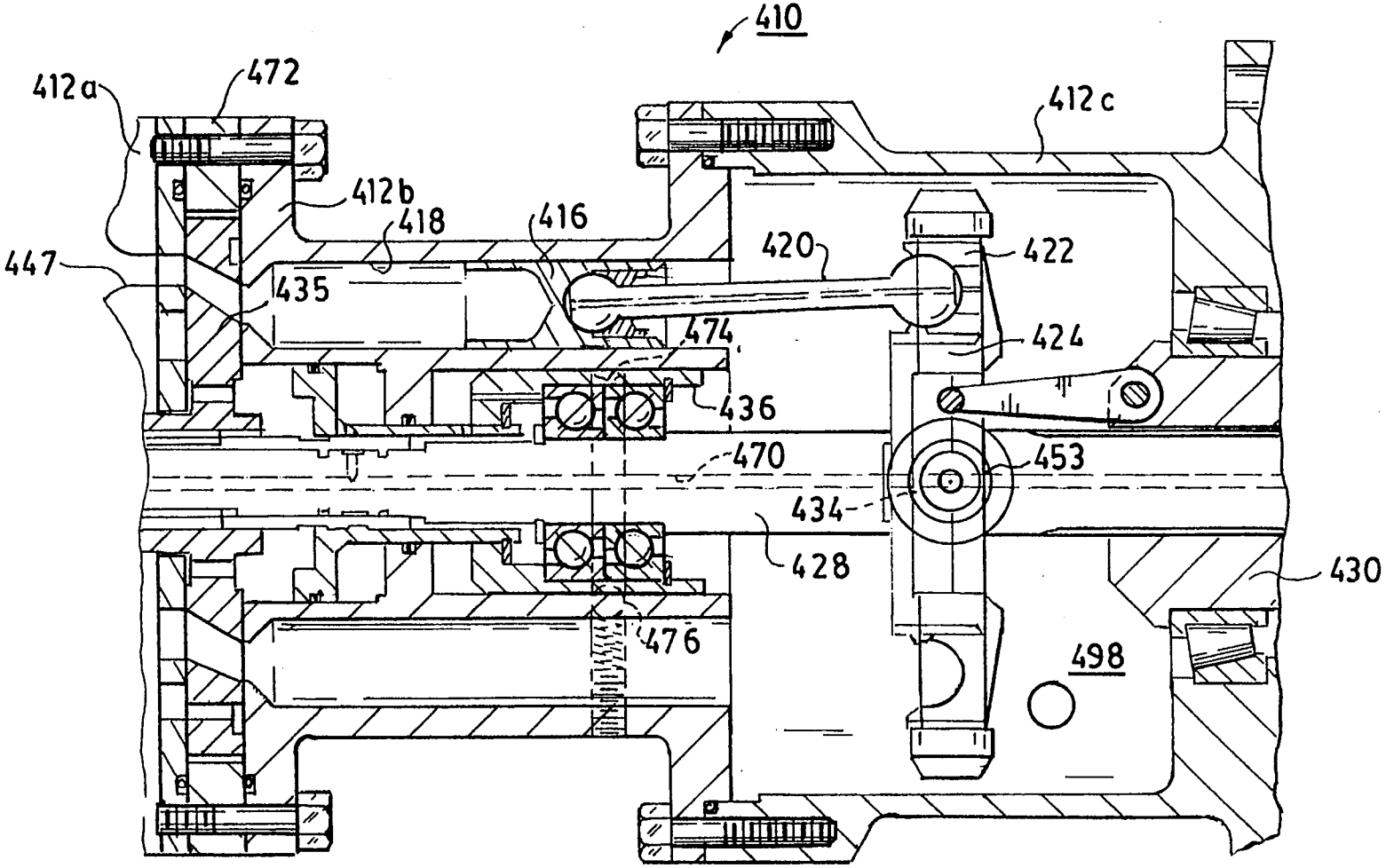

FIG. 18 is a schematic cross-sectional view of a mechanism, appropriate for Use with all adjustable swash-plate embodiments of the inventive hydraulic machine, for positioning the swash-plate at a slight angle for permitting minimal piston reciprocation to provide sufficient operating fluid pressure for lubricating purposes.

Figure 20:
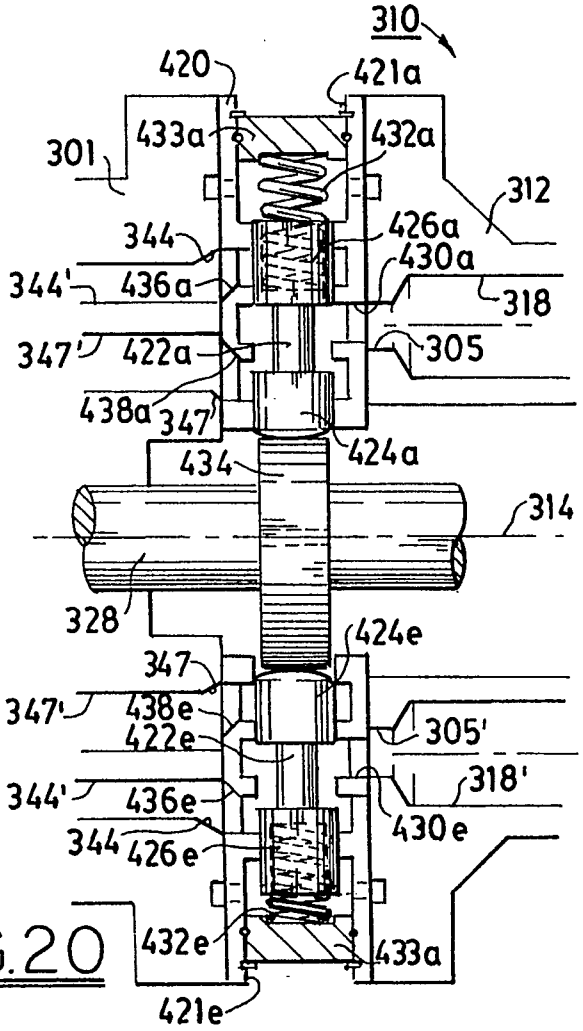
Figure 19:
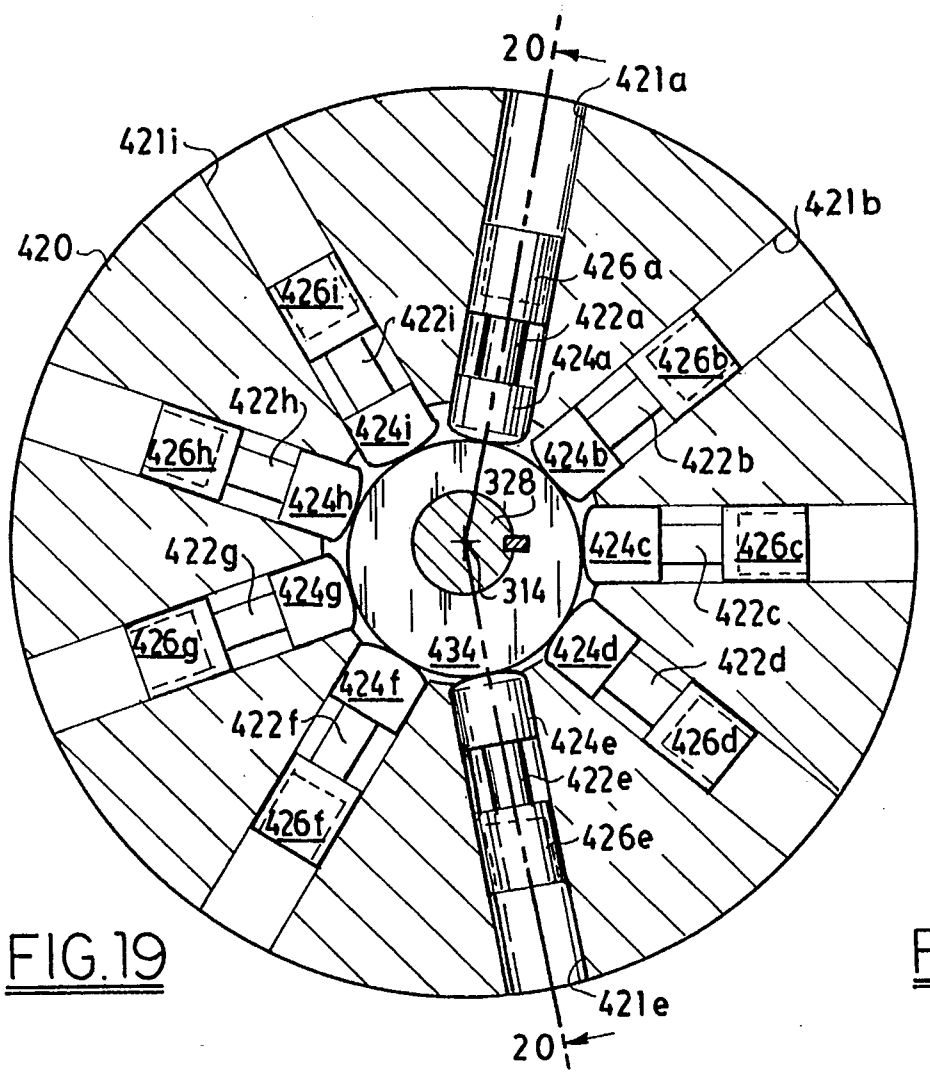

FIGS. 19 and 20 are two schematic views of a disk-shaped radial-valve insert which can be used as a replacement for the disk-shaped valve-plate disclosed in FIGS. 16 and 17, FIG. 20 being an end view taken along the bent plane 20—20 in FIG. 19.

Figure 21:
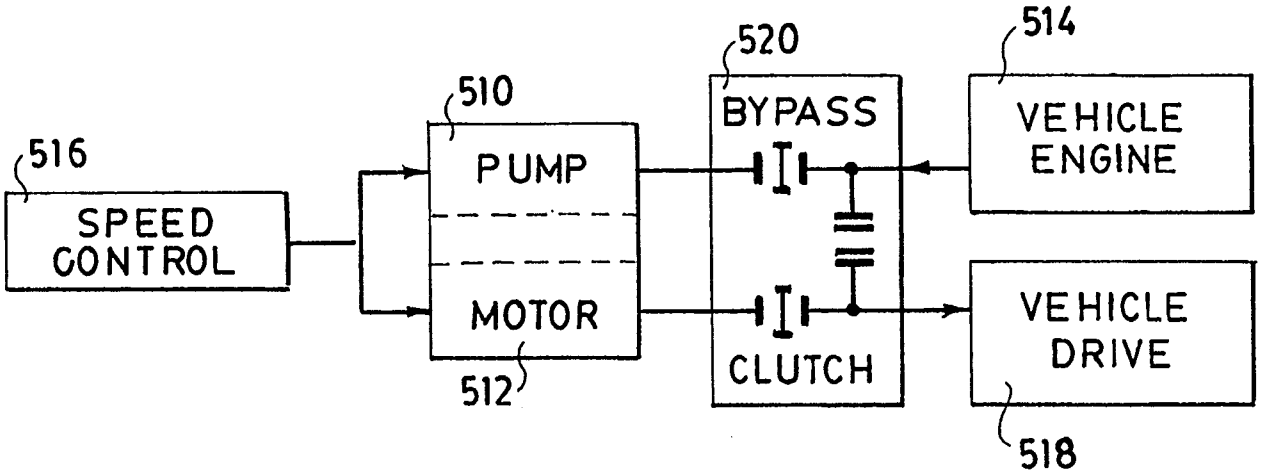

FIG. 21 is a schematic block diagram of an embodiment in which a combination pump and motor according to the invention is used with a vehicle drive.

DETAILED DESCRIPTION OF PREFERRED EMBODIMENTS

Hydraulic Pump

Figure 1:
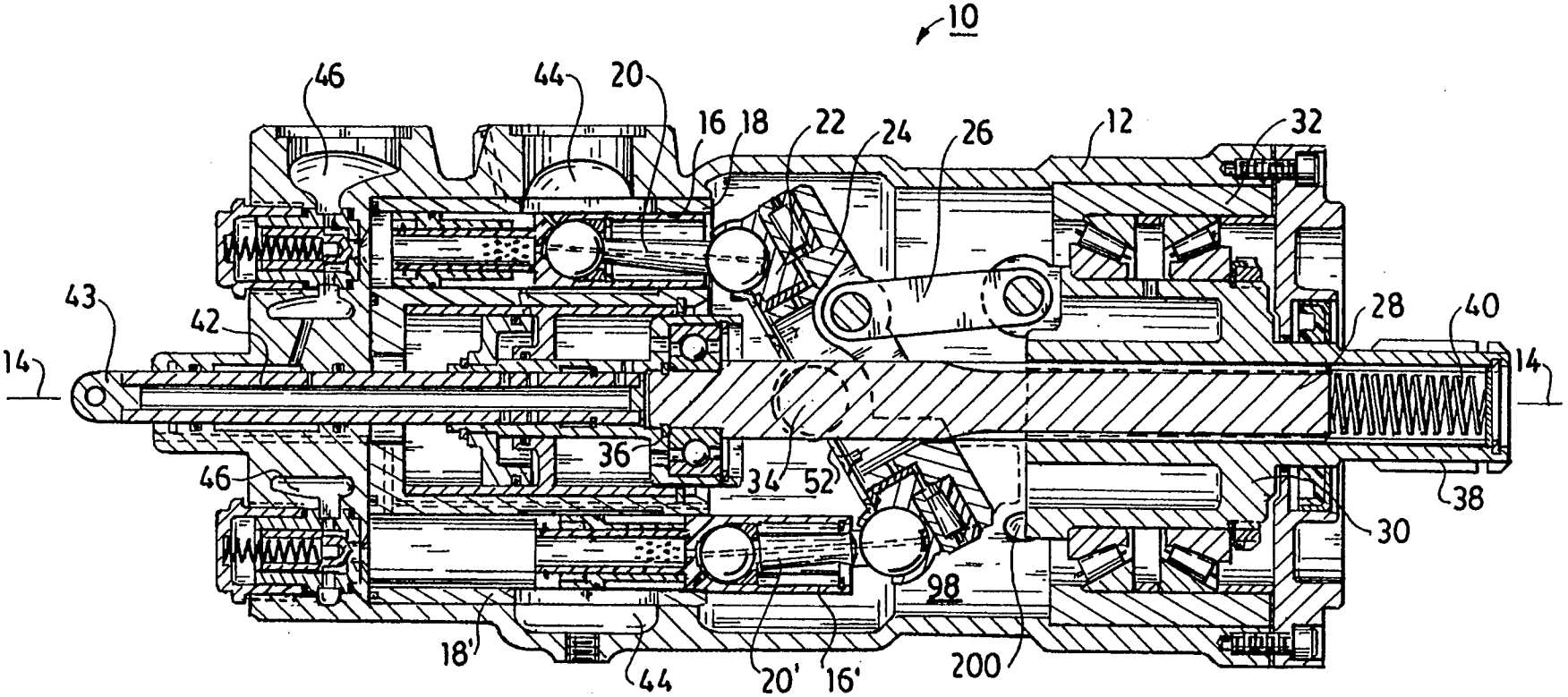
FIG. 1 is a cross-sectional view of a first embodiment of the variable hydraulic machine of the invention as a pump.

The variable hydraulic machine of the invention will be first described in the form of the pump embodiment shown in overall cross section in FIG. 1. The pump 10 is entirely mounted within a generally cylindrical housing 12 with all of its major component parts positioned about a central axis 14. A plurality of pistons 16, 16' reciprocate in respective cylinders 18, 18', the latter being fixed within housing 12. Pistons 16, 16' are driven axially by respective ball-ended connecting rods 20, 20' which are driven, in turn, by a split swash-plate structure which has a non-rotatable portion 22 which is nutated by a rotating portion 24.

Rotatable portion 24 of the swash-plate is rotated primarily by means of a toggle-link 26 connected to a drive element 30 which is mounted concentric with axis 14. A main bearing unit 32, which supports drive element 30, is in the form of a removable cartridge that can be modified and replaced in accordance with the horsepower specifications for which pump 10 is designed.

Positioned concentric with drive element 30 and splined thereto is a slideable shaft 28 having an integral T-bar pivot 34 which supports rotatable portion 24 of the swash-plate and about which the split swash-plate pivots. The left end of shaft 28 rotates within a movable bearing 36.

The pivotal connection between toggle-link 26 and rotatable portion 24 is positioned quite close to axis 14 so that main bearing unit 32 carries the major portion of the load exerted by pistons 16, 16' and so that movable bearing 36 carries a substantially lesser portion of the load. Since this mounting arrangement reduces the force needed to adjust the position of shaft 28 and T-bar pivot 34, control of swash-plate inclination can be readily achieved by a relatively small and concentrically-located servo structure (explained in detail below), a feature that serves to reduce significantly the overall size of pump 10.

A hub 38 formed at the right-hand end of drive element 30 protrudes from housing 12 and is rotated by external means (not shown), such as the engine of an automotive vehicle.

A control rod 42, which includes a positioning stem 43 that extends from the left end of cylindrical housing 12, operates a servo mechanism (described in greater detail below) for positioning movable bearing 36. That is, adjustment of positioning stem 43 controls the position of T-bar pivot 34 and the inclination of split swash-plate 22, 24. Under the condition illustrated in FIG. 1, positioning stem 43 has been adjusted by external means (not shown) to move control rod 42 to its right-most position, moving shaft 28 to position T-bar pivot 34 as indicated. This inclines the swash-plate so that its portion 22 nutates and pistons 16, 16' reciprocate in cylinders 18, 18' through maximum-length strokes determined by the illustrated maximum inclination of the swash-plate (e.g., approximately 30°).

When the pump is not in operation, the bias of a spring 40 (mounted within hub 38) causes shaft 28 to move to the left until T-bar pivot 34 is positioned in a manner that places the swash-plate in its position of minimum inclination (e.g., 0°). Under these effectively no-load conditions, while the swash-plate's rotating portion 24 may continue to turn in response to the rotation of drive element 30, there is no appreciable nutation of the swash-plate's non-rotating portion 22 and, therefore, pistons 16, 16' do not reciprocate. This spring-bias feature of the invention has a further advantage: Namely, when the system is started up after being deactivated, e.g., when a vehicle in which the system is included is put into operation, the swash-plate is always in its "no-load" position so that no appreciable hydraulic load is placed on the vehicle's engine during start-up.

However, whenever the swash-plate is inclined beyond 0°, the pistons begin to reciprocate, and low-pressure operating fluid enters the cylinders through an intake passageway 44, while high-pressure fluid leaves the pump through an exit passageway 46. This pressure-generating procedure will now be described with reference to FIGS. 2A and 2B.

Each connecting rod 20, 20' is formed with a ball at each end, the smaller ball 48, 48' being held in a spherical bearing formed in piston 16, 16' while the larger ball 50, 50' is held against nutatable-but-non-rotatable portion 22 of the split swash-plate by a sheet metal cover 52 (see FIG. 1) that is bolted to and rotates with rotating portion 24 of the split swash-plate. This relatively inexpensive manufacturing feature is possible because, in this lower horsepower embodiment, the swash-plate can be held in position solely by the hydraulic pressure developed during the power strokes of pistons 16, 16'. Further, since the novel design of this pump does not require the heavy spring bias used in prior art pumps to prevent excessive blowby, sheet metal cover 52 has sufficient strength to pull connecting rods 20, 20' and pistons 16, 16' back during each respective fill stroke. This operation is also facilitated by the presence of pressure-balancing channels 54, 54' which are drilled through connecting rods 20, 20' in a manner well known in the art.

Figure 2A:
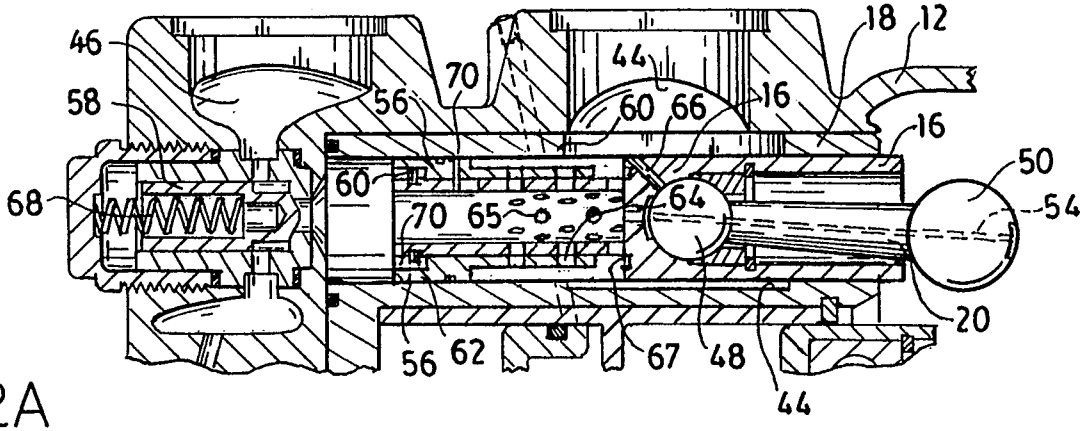
FIGS. 2A and 2B are enlarged and more detailed views of the piston/cylinder portions of the pump illustrated in FIG. 1, FIG. 2A showing the upper piston positioned near the beginning of its fluid intake stroke.
Figure 2B:
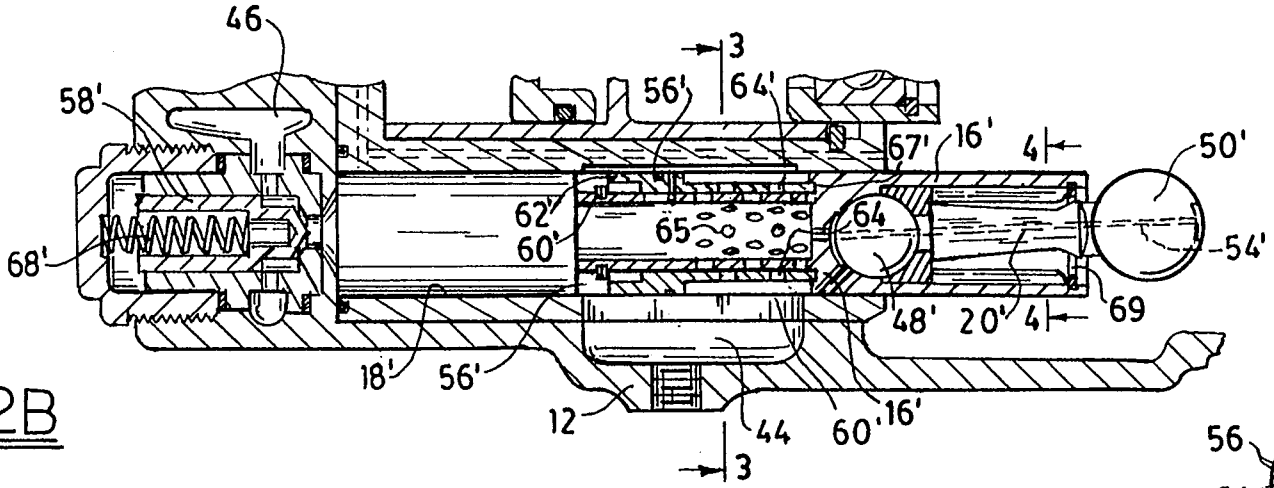

FIG. 2A shows piston 16 after it has started pulling back a short distance to the right at the beginning of its intake stroke. Similarly, FIG. 2B shows piston 16' shortly after it has begun moving to the left on its power stroke. Fitted around the left end of each piston 16, 16' is a circumferential shuttle valve 56, 56' that is free to move a relatively short distance axially relative to the piston. In FIG. 2A, shuttle valve 56 is in its extended position relative to piston 16, while in FIG. 2B, shuttle valve 56' is in its retracted position relative to piston 16'.

Due to these relative motions (which are described in greater detail below), when shuttle valve 56 is in its extended position, operating fluid is permitted to enter cylinder 16 from intake passageway 44 through aligned ports 64 and 65 formed in shuttle valve 56 and piston 16, respectively (also shown in detailed cross section in FIG. 3); and when shuttle valve 56' is in its retracted position on the power stroke of piston 16', ports 64' and 65' are no longer in alignment, blocking the connection with intake passageway 44, and the operating fluid is pressurized in cylinder 18' and delivered through exit valve 58' to exit passageway 46.

The operation of shuttle valve 56, 56' is as follows: A piston ring 60, 60' is fixed around the left end of piston 16, 16', while the left end of shuttle valve 56, 56' is provided with a projecting flange 62, 62'. As piston 16 is being initially withdrawn by its connecting rod 20, shuttle valve 56 is momentarily held in position by inertia; and this momentary delay allows piston 16 to move relative to shuttle valve 56 which momentarily remains in its extended position in which the base of its projecting flange 62 is in contact with piston ring 60, as shown in FIG. 2A. This relative movement of shuttle valve 56 aligns ports 64 and 65 as explained above and allows low-pressure fluid to enter into cylinder 18 from surrounding intake passageway 44. At the same time, to minimize the possibility of cavitation, a very slight clearance (e.g., 0.015"/0.375 mm) between connecting rod ball 48 and its spherical mounting in piston 16 allows low-pressure fluid to also enter cylinder 18 from passageway 44 through piston head intake port 66 in the head of piston 16. At this time, a valve 58, under the bias of a spring 68, closes off the bottom of piston 16 from high-pressure fluid in exit passageway 46.

After each piston passes the top of its stroke, its corresponding shuttle valve moves to the retracted position as shown in FIG. 2B. Namely, as connecting rod 20' begins to move piston 16' to the left, the inertia of shuttle valve 56' causes it to continue its right-hand axial motion until its right end seats in circumferential slot 67' formed in piston 16'. In this retracted position, intake ports 64' and 65' move out of alignment, blocking off the flow of operating fluid from intake passageway 44, and the left-hand motion of piston 16' pressurizes the operating fluid in cylinder 18'.

The fluid pressurized in cylinder 18' overcomes the bias of spring 68' and opens valve 58' to permit pressurized fluid to enter exit passageway 46. Special attention is called to the design of exit valve 58, 58' in which spring 68, 68' is positioned within a cylindrical sheath that prevents the spring from being blown out by the explosive hydraulic forces generated in the cylinders at faster operating speeds. This exit valve arrangement prevents blowby without requiring excessive spring forces, and our pump provides meaningful operating horsepower as soon as the pistons begin moving.

Attention is also called to a further design feature relating to shuttle valves 56, 56': The mass of pistons 16, 16' is considerably greater than that of their related shuttle valves 56, 56', thereby reducing the tendency of the latter to bounce following the short relative axial movement just described above. In addition, operating fluid enters into the space 70 and slot 67' to hydraulically cushion the relative movement between piston 16, 16' and shuttle valve 56, 56'. This design feature reduces tappet-type noise.

Figure 4:
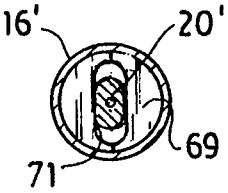
FIG. 4 is a cross-sectional view taken along line 4—4 of FIG. 2B showing connecting-rod restraining means in the form of a piston end cap provided to maintain the position of the pistons relative to the machine's swash-plate.

Since all of the connecting rods 20, 20' are spherically mounted at each of their respective ends, restraining means must be provided to maintain the parallel alignment of the connecting rods and to prevent their collapse to one side or the other under the tangential forces related to the relative rotation between the two portions of the split swash-plate. In prior art pumps, this required restraining means comprises such apparatus as anchoring balls or pads sliding in channel guides. In our design, two different types of restraining means are provided, both of which are much simpler and less expensive than those in the prior art. The preferred restraining means for our hydraulic machines designed for significant horsepower requirements (e.g., automotive) comprises a gimballed structure for supporting the non-rotatable portion of the split swash-plate. This preferred means will be described in detail below. However, a much simpler restraining means is provided in this first embodiment which is designed for lower horse-power use. Namely, one or more of the pistons are merely fitted with an end cap 69 as shown in FIGS. 2B and 4. End cap 69 is provided with a slot 71 which receives the central portion of connecting rod 20'. By this means, the motion of control rod 20' is restrained to one plane relative to piston 16', and such restraint applied to one or more of the connecting rods serves to maintain all of the connecting rods in alignment about the axis of drive shaft 28.

Figure 5:
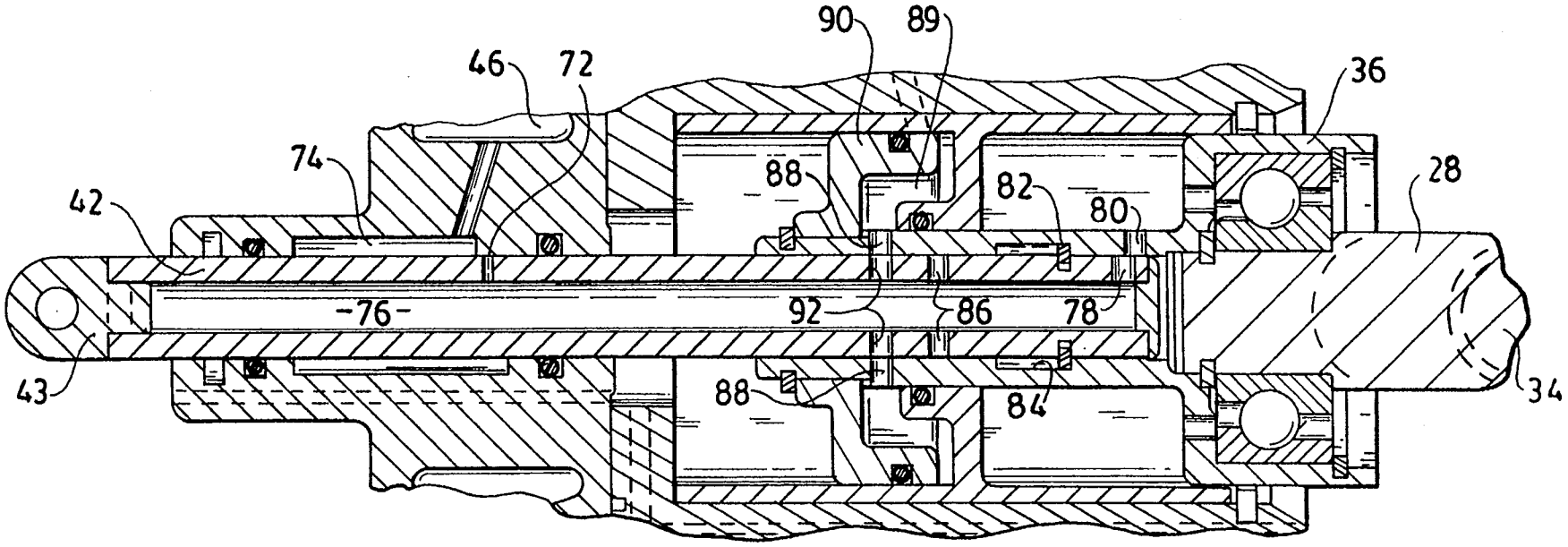
FIG. 5 is an enlarged view of the servo control mechanism for positioning the swash-plate of the machine of FIG. 1.

When operating in the manner pictured in FIG. 1, the pressure exerted by the pistons against nutating portion 22 holds the swash-plate in its maximum inclination so that pistons 16, 16' are reciprocating at full stroke. However, as indicated above, the output of pump 10 can be varied by reducing the stroke of pistons 16, 16' by controlling the inclination of split swash-plate 22, 24. Such variable control is accomplished by means of a servo mechanism which shall now be described with reference to FIG. 5 (showing an expanded view of the central portion of the left half of the pump structure of FIG. 1).

To reduce the fluid output of pump 10, T-bar pivot 34 is moved to the left as follows: Positioning stem 43 is initially pulled to the left by external means (not shown) moving a fluid inlet 72 of control rod 42 into alignment with a high-pressure port 74 which is connected to exit passageway 46. This allows high-pressure fluid to enter the core 76 of control rod 42 and, at the same time, moves the control rod's fluid outlet 78 out of alignment with a low-pressure dump channel 80 leading to the pump's dry sump, thereby preventing further dumping of fluid from core 76. High-pressure fluid fills core 76 and moves control rod 42 further to the left until a ring 82, fitted around control rod 42, moves into contact with the left end of a slot 84 formed in movable bearing 36. At this point, a set of right-hand ports 86 are in alignment with a set of channels 88 to permit high-pressure fluid to begin filling the cavity 89 to the right of a servo piston 90 which is fixed to movable bearing 36. Servo piston 90 and bearing 36 move to the left together until channels 88 are no longer aligned with right-hand ports 86. When this occurs, ring 82 is positioned approximately at the middle of slot 84 and the mechanism comes to a stop until positioning stem 43 is moved again in either direction.

Control rod 42 can be moved to the left, intermittently or continuously, until servo piston 90 and movable bearing 36 reach the end of their stroke, at which time T-bar pivot 34 is positioned so that the split swash-plate is at 0°-inclination. In this totally withdrawn position, ring 82 of control rod 42 is once again in the center of slot 84 and all ports and channels of the servo mechanism, with the exception of inlet 72, are blocked. Although this leftward motion of T-bar pivot 34 is opposed to the large forces being exerted on the swash-plate by the reciprocating pistons, it is readily accomplished by relatively small servo piston 90 because, as indicated above, the major portion of the opposed forces is carried by main bearing 32 through toggle-link 26 (FIG. 1); and, further, this leftward motion is also aided by the bias of spring 40 acting on shaft 28. This just-described feature is quite significant, since it permits the entire servo control mechanism to be mounted concentrically and entirely within the pump housing, thereby providing substantial reductions in the size, weight, and cost of our hydraulic machine.

Two other important features of our servo mechanism are (a) servo piston 90, control rod 42, and positioning stem 43 do not rotate, and (b) positioning stem 43 is located centrally of pump 10 and at the end opposite to hub 38 of drive element 30. Thus, the servo elements and their operating fluids develop an centrifugal forces that would otherwise require compensation, again reducing size and cost; and positioning stem 43 can be simply hooked up to external linkage (not shown) for controlling its operation without complex arrangements to avoid interference problems.

To move T-bar pivot 34 of drive shaft 28 back to the right, positioning stem 43 of control rod 42 is moved slightly to the right until ring 82 is once again against the right-hand edge of slot 84 (i.e., as shown in FIG. 4) and fluid outlet 78 is once again aligned with low-pressure dump 80. This small amount of movement of control rod 42 produces a slight adjustment of the position of movable bearing 36 and T-bar pivot 34 so that split swash-plate structure 22, 24 tilts sufficiently to allow some movement by pistons 16, 16' which, in turn, press against the swash-plate structure to move bearing 36 slightly further to the right. This brings a set of left-hand control ports 92 in control rod 42 into alignment with channels 88 leading to fluid-filled area 89 to the right of servo piston 90, permitting the high-pressure fluid in area 89 to begin dumping through outlet 78 and low-pressure fluid dump 80, and allowing movable bearing 36 to be moved further to the right under the pressure developed by the pump's pistons. Unless stopped, this movement under the pressure generated by the increasing stroke of the pistons will continue until T-bar pivot 34 moves to its illustrated position for maximum inclination of split swash-plate 22, 24.

However, the movement toward maximum inclination can be prevented by stopping the rightward movement of control rod 42 at any desired position. When control rod 42 is stopped, the movement of servo piston 90 and movable bearing 36 will also stop is soon as low-pressure dump 80 is moved out of alignment with outlet 78. Thus, the inclination of split swash-plate 22, 24 is continuously adjustable by the positioning of control bar 42 and the hydraulic assistance of servo piston 90.

Hydraulic Motor

Figure 6:
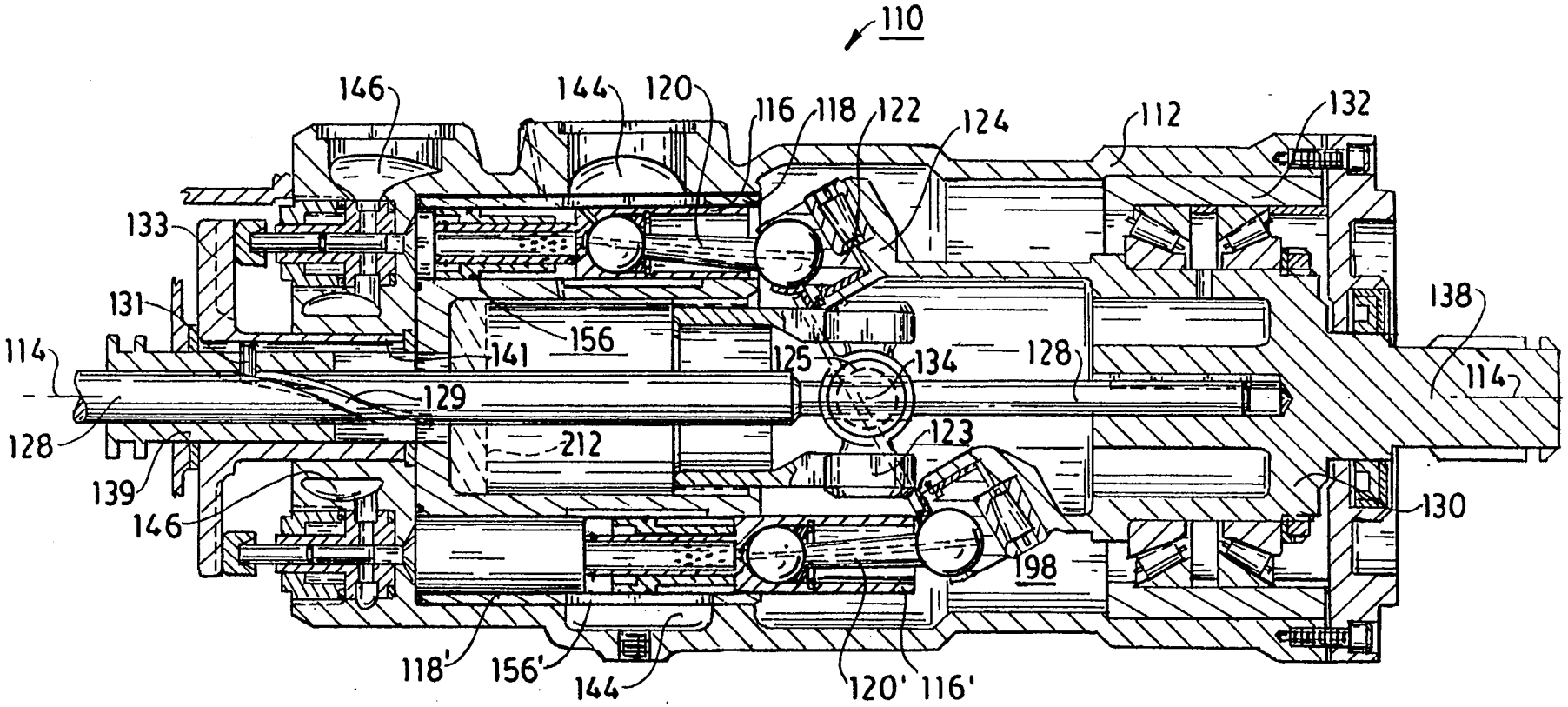
FIG. 6 is a cross-sectional view of a hydraulic motor embodiment of the invention.

The variable hydraulic machine of the invention will now be described in the form of the motor embodiment shown in overall cross section in FIG. 6. The motor 110 is mounted entirely within a generally cylindrical housing 112 having all of its major component parts positioned about a central axis 114. Most of the components of motor 110 are similar or identical to the components which make up pump 10 described above, and similar reference numerals (but exactly 100 units larger) are used to identify these similar components. A plurality of pistons 116, 116' reciprocate in respective cylinders 118, 118', the latter being fixed within housing 112. Pistons 116, 116′ move axially within their respective cylinders and drive respective ball-ended connecting rods 120, 120′ which, in turn, cause the nutation of a split swash-plate structure comprising a nutatable-but-non-rotatable portion 122 and a rotatable portion 124.

Reciprocation of pistons 116, 116′, acting through connecting rods 120, 120′, cause swash-plate portion 122 to nutate about the center 134 of a gimballed structure supported by a yoke 123 that is mounted to housing 112. Since yoke 123 is fixed to the housing, pivot point 134 also remains fixed; and the inclination of split swash-plate 122, 124 is always set at the maximum inclination indicated (e.g., around 30°). Therefore, when motor 110 is operated in tandem with the invention's pump 10, and when the swash-plate of pump 10 is also operating at its maximum inclination (as shown in FIG. 1), both pump 10 and motor 110 operate at similar speeds and pressures. However, as is well known in the art, as the inclination of the pump's swash-plate is reduced from its maximum 30°-position, the pressure developed by pump 10 (assuming the pump is being driven at a constant horsepower) increases accordingly; and this in turn increases the pressure of the operating fluid being delivered to motor 110.

This increase in pressure on the non-rotating portion 22 of the pump's swash-plate can be adequately supported by the mechanism shown in FIG. 1 because, as the inclination of the split swash-plate is reduced, the moment arms about T-bar pivot 34 and toggle-link 26 are proportionately reduced. However, since the inclination of the motor's swash-plate remains fixed, these increasing pressures continue to act about the same long moment arms, thereby magnifying the torsional forces acting on the motor's swash-plate structure as compared to the forces acting on the pump's swash-plate structure under these same pressure conditions.

To support these larger forces, our motor 110 is provided with a slightly different mounting structure for split swash-plate 122, 124. Rotating portion 124 of the split swash-plate is supported directly by a drive element 130 carried in a main bearing 132. (In a manner similar to the design of pump 10, main bearing 132 is in the form of a replaceable cartridge that can be changed to meet the desired horsepower specifications of motor 110.) Further, nutating portion 122 of the motor's split swash-plate is supported, as indicated above, by a gimballed-yoke type of structure. That is, portion 122 is mounted ion a first axle 125 which, in turn, is rotatably carried by a second axle that is rotatable in yoke 123. This gimballed-yoke structure is another feature that makes it possible for our hydraulic machine to handle higher pressures and speeds than commercially-available devices of similar displacement, while doing so with apparatus that is lighter in weight and more compact.

Figure 3:
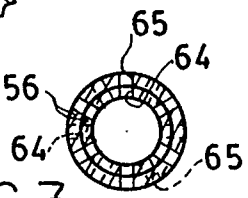
FIG. 3 is a cross-sectional view taken along line 3—3 of FIG. 2B showing a piston and its associated shuttle valve and the position of the valve ports therein.

The operation of pistons 116, 116′ is similar to the operation of pistons 16, 16′ as described above, except that high-pressure fluid is received through intake passageway 144, while low-pressure fluid is returned to the fluid reservoir through exit passageway 146. Similarly, the shuttle valves 156, 156′ operate in the same manner as shuttle valves 56, 56′ discussed above with reference to FIGS. 2A and 2B. Namely, as piston 116 moves to the right from the position shown in FIG. 6, the inertia of shuttle valve 156 opens cylinder 118 to high-pressure fluid being delivered from pump 110 through intake passageway 144. That is, the motor's pistons more from left to right on the power stroke and from right to left on their exhaust stroke. In FIG. 6, piston 116′ is shown just before it reaches the end of its power stroke during which shuttle valve 156′ has been positioned to the left relative to piston 116′, opening the intake ports (as shown in FIGS. 2A and 3) and allowing high-pressure fluid to enter cylinder 118′. Immediately after the instant illustrated in FIG. 6, connecting rod 120′ begins to move piston 116′ in the leftward direction, and the inertia of shuttle valve 156′ moves it to the right relative to piston 116′, thereby closing off the intake ports (as shown in FIG. 2B) so that no high-pressure fluid enters cylinder 118′ during the return/exhaust stroke of piston 116′, as will be discussed in further detail below.

The nutating of portion 122 of the motor's split swash-plate causes the nutation and rotation of portion 124 which, as indicated above, is fixed to drive element 130. Thus, as the high-pressure fluid from pump 10 drives pistons 116, 116′ of motor 110, portion 124 of the split swash-plate is rotated and, in turn, rotates drive element 130 and its take-off hub 138, providing the output of the pump/motor combination.

Figure 7:
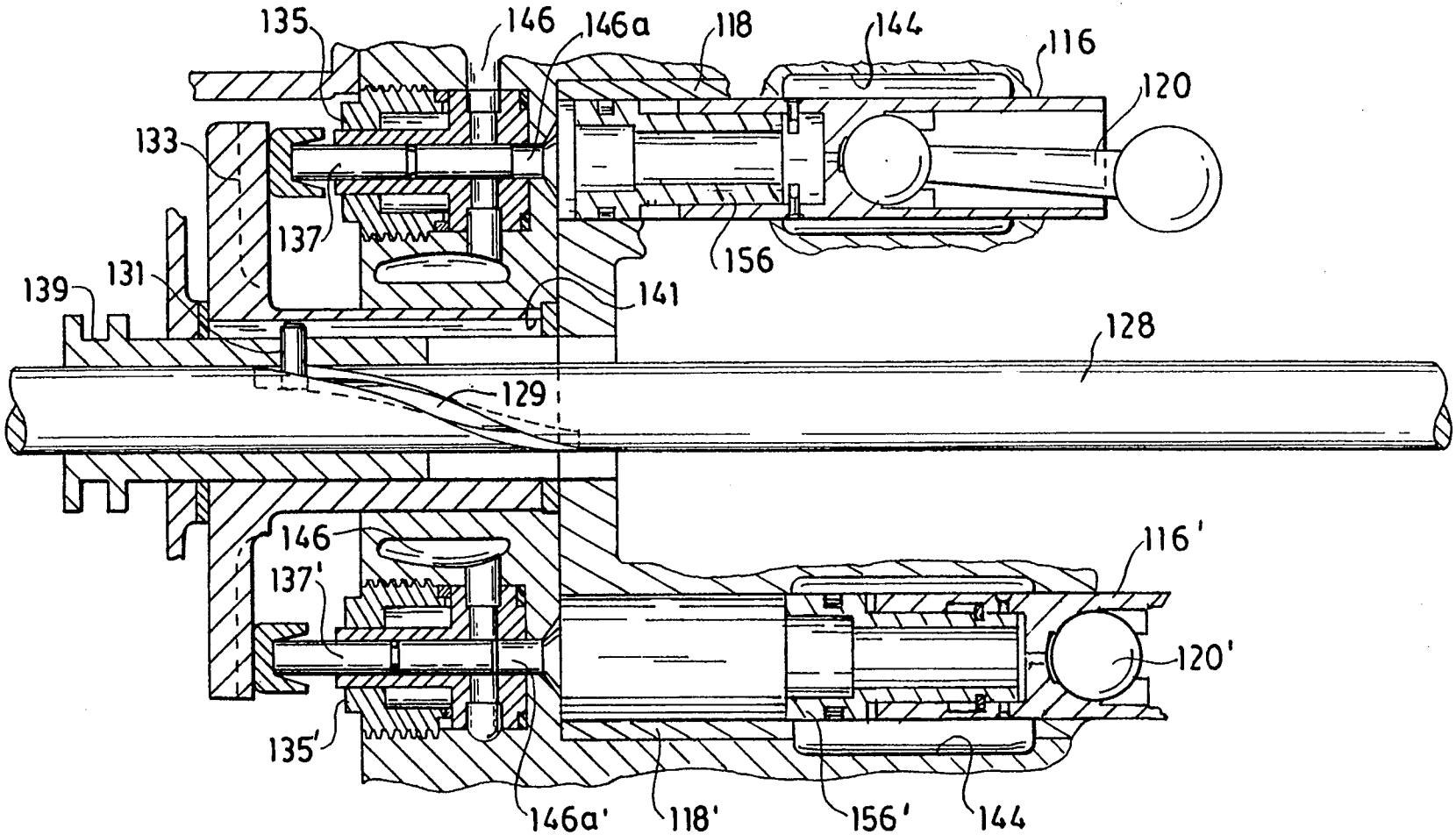
FIG. 7 is an enlarged view of the left end of the motor illustrated in FIG. 6, showing the cam-operated valves used to control the exhaust of fluid from the cylinders and to control the direction of rotation of the motor's output shaft.

Splined or keyed to drive element 130 is a shaft 128 which passes completely through appropriate openings in the axles of the gimballed structure supported by yoke 123. At its left end, shaft 128 has a helical slot 129 which receives a drive pin 131 carried by a control sleeve 139. Drive pin 131 also rides in an axial slot 141 formed in a cam element 133 so that cam 133 rotates with shaft 128. This can best be seen in reference to FIG. 7 which shows an expanded view of a portion of the left end of motor 110.

Exit valve units 135, 135′ include exit valve stems 137, 137′ which can be moved to open and close the exit ports 146*a*, 146*a*′ that connect the bottom of each cylinder 118, 118′ with exit passageways 146, 146′. Cam 133 moves respective valve stems 137, 137′ into a closing relationship with exit ports 146*a*, 146*a*′ during the time that pistons 116, 116′ are moving to the right during their power strokes; and cam 133 also allows valve stems 137, 137′ to move to the left to open passageways 146*a*, 146*a*′ to exhaust cylinders 118, 118′ when pistons 116, 116′ move to the left on their return/exhaust strokes.

Formed at the left end of control sleeve 139 is a pulley-like hub which cooperates with an appropriate shifting yoke (not shown) which can be used to move control sleeve 139 axially relative to shaft 128. When control sleeve 139 is moved to the right from the position shown in FIG. 7, drive pin 131 rides along both helical slot 129 and axial slot 141, causing cam element 133 to rotate relative to shaft 128 by 180°. It is assumed that When the components of motor 110 are in the position shown in FIGS. 6 and 7, initial movement of pistons 116, 116′ (in response to pressurized fluid circulating from the pump) causes drive element 130 and shaft 128 to rotate in a clockwise direction. Contrarily, when cam 133 is rotated 180° relative to shaft 128, initiation of the motion of pistons 116, 116′ results in counterclockwise rotation of drive element 130 and shaft 128.

Preferred Pump/Motor Arrangement

Figure 8:
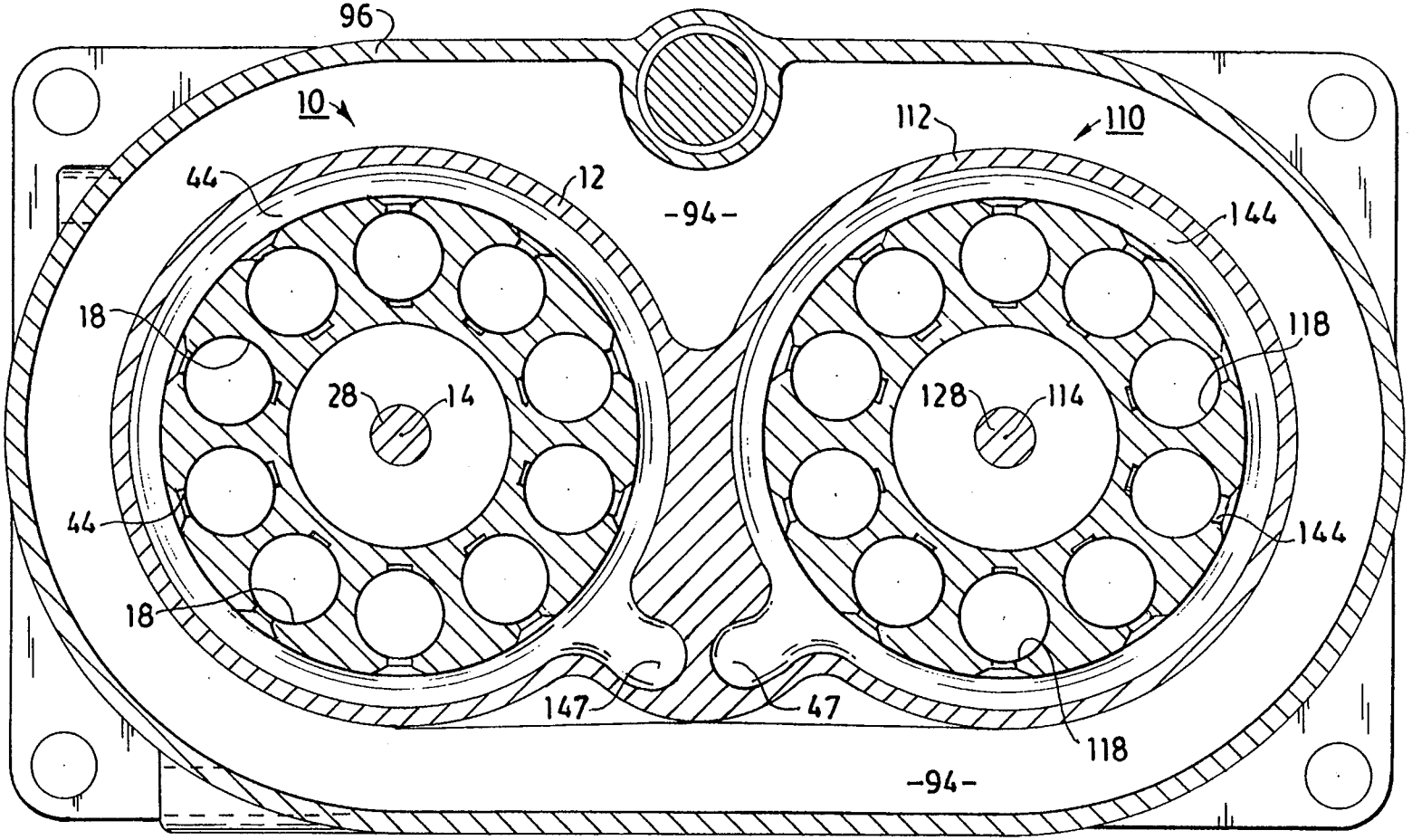
FIG. 8 is a schematic cross-sectional view of a pair of hydraulic pump/motor machines according to the invention, each mounted in similar cylindrical housings combined in a compact, side-by-side mounting arrangement within a single surrounding casing that forms a reservoir for the operating fluid for the pump/motor units.

FIG. 8 illustrates another feature of a preferred embodiment of our invention. Pump 10 and motor 110 are mounted in side-by-side relationship, and their respective cylindrical housings 12 and 112 are formed as a single, combined unit, appropriately joined and interconnected by a plurality of inter/intra-housing conduits. Intake passages 44 of pump 10 (see FIG. 1) as well as exit passageway 146 of motor 110 (see FIG. 6) are interconnected with each other through a first conduit 147. Similarly, a second conduit 47, also formed within the joined housings 12, 112, conducts fluid from exit passageway 46 of pump 10 (see FIGS. 1, 2A, and 2B) to intake passageway 144 of motor 110 (see FIG. 6). This forms a "closed-loop" hydraulic system which permits the fluid to maintain its velocity as it continues to pass from pump 10 to motor 110; and it will be understood by those skilled in the art that in other embodiments in which pump 10 is reversible (such as that shown in FIG. 10 and discussed below), the "intake" and "exit" passageways are merely "first" and "second" passageways through which the direction of fluid movement can become reversed as it travels between pump 10 and motor 110.

In this regard, this closed-loop system is also appropriately interconnected through one-way ball valves (not shown) to a fluid reservoir 94 that surrounds housings 12, 112. With this arrangement, which is well known in the art, fluid lost to blowby and used for lubricating purposes is automatically replenished to the low-pressure side of the closed-loop to maintain the fluid volume of the system.

In the particular preferred embodiment illustrated in FIG. 8, reservoir 94, which is maintained under a relatively low pressure (e.g., 45 psi), is formed within an overall casing 96 that holds both the combined pump and motor units in the relative position indicated.

In addition to its remarkably compact, small size and weight, this side-by-side arrangement makes it possible to transfer very high-pressure operating fluid between the pump and motor through steel conduits without requiring the use of specially-sealed exterior hoses, facilitating operation at much higher speeds and pressures than are presently provided by most available hydraulic pump/motor systems.

As indicated above, the arrangement shown provides a further important advantage. Namely, since fluid reservoir 94 surrounds both pump 10 and motor 110, it acts as both a heat sink for these hydraulic units as well as a sound insulator for reducing any noise generated during the operation of the units.

Fluid Replenishment System

Figure 9:
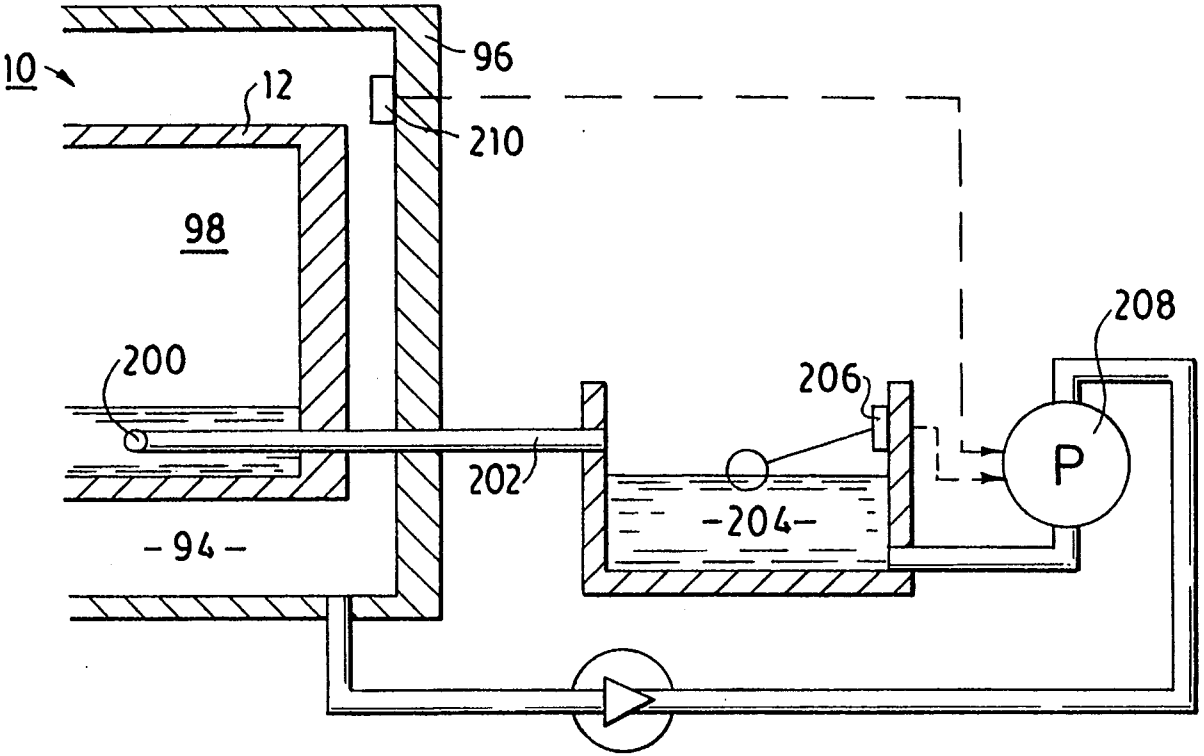
FIG. 9 is a schematic diagram of a fluid-replenishing system for maintaining fluid under low pressure within the surrounding reservoir shown in FIG. 8.

FIG. 9 is a schematic diagram of a fluid-replenishing system for used with the just-described novel arrangement of the invention illustrated in FIG. 8. A relatively small volume ( e.g., one quart ) replenishment reservoir 204 is positioned outside the exterior casing 96 and is appropriately positioned and marked in a manner well known in the art to permit the operator of the hydraulic machine to replenish and maintain hydraulic fluid at levels required for proper operation of the pump/motor system. A fluid-level/pressure detector 210, mounted within casing 96, initiates operation of a pump 208 to replenish lost operating fluid from replenishment reservoir 204 and to maintain the pressure within reservoir 94 at desired limits. In the preferred embodiments, the pressure of reservoir 94 is maintained under a relatively low pressure (e.g., 45 psi) so that pump 208 can be a relatively small and economical component.

Dry Sump

Special attention is now called to one of the most important features of our invention: The split swash-plate structures in each embodiment of our hydraulic machine rotate in dry sumps. Referring to the already disclosed embodiments of pump 10 and motor 110, the dry sumps are identified, respectively, by reference numerals 98, 198; and these dry sumps contain only blowby and a small amount of operating fluid that is also used for lubricating purposes and to operate the servo mechanism. That is, the swash-plates and their respective drive elements 30 and 130, as well as shafts 28 and 128, do not rotate in operating fluid, thereby avoiding the power losses and temperature buildups that are caused by fluid drag in most commercially-available units. Therefore, when used in conjunction with a vehicle drive, there is no need to declutch our hydraulic pump when the vehicle reaches road speeds and is operating 1:1 with the vehicle engine; because, when the pump's swash-plate is at its minimum inclination, its moving elements are all rotating on ball bearings in a dry sump, creating a negligible load on the vehicle's engine.

Special means are provided to prevent the overfilling of these dry sumps. In one embodiment (shown in FIGS. 1 and 9), a drain 200 is mounted in the bottom of the dry sump, and it is located so that it permits approximately 2.5 cm (1.0 inch) of fluid to collect in the sump for lubrication purposes. (Note: While drain 200 is only shown in regard to pump 10, a similar drain is also located in each of the other embodiments.)

Excess fluid in the dry sumps of the pump and motor units are returned through respective drains 200 and pipes 202 to replenishment reservoir 204. Losses of operating fluid through drains 200 are indicated by a rising level of fluid in replenishment reservoir 204, and such lost fluid is noted by level detector 206 which initiates the action of small pump 208 to return the lost fluid to reservoir 94.

In a preferred embodiment for the replenishment system, a small gear pump 212 (shown schematically in FIG. 6) is located in the dry sump of motor 110 and is keyed to and driven by shaft 128. The dry sumps of the pump and motor units are connected (e.g., through passageways integrated in their joined housings in the preferred side-by-side units shown in FIG. 7); and blowby, as well as operating fluid used for lubrication and servo operation, is returned to reservoir 94 by operation of gear pump 212. The advantages of this preferred gear-pump arrangement are (a) the gear pump only uses engine power when the hydraulic motor is being used, i.e., replenishment pump 212 does not act as a fluid drag on the vehicle engine when the hydraulic system is not operating; (b) replenishment power is only used when needed; and (c) since the blowby, servo, and lubricating fluids are not returned to atmospheric pressure prior to being returned to reservoir 94, less engine power is required for replenishment.

Although pump 10 has been disclosed in combination with motor 110 in the description of the preferred embodiment of the invention, pump 10 can also be used alone to provide versatility and variable hydraulic control for industrial hydraulic drives. Since pump 10 operates hydrodynamically, as different from the hydrostatic operation of most presently-used industrial hydraulic pumps, it can be operated more efficiently, using the full horsepower of its related engine rather than dumping pressure during low-speed operation, as explained above.

Valve-Plate Embodiment

Reference will now be made to FIG. 10, which is a partially schematic cross-sectional view of the swash-plate and cylinder/piston portions of a further hydraulic machine embodiment of the invention. Most of the components of machine 210 are similar or identical to the components which make up pump 10 as described above and shown in FIG. 1, and similar reference numerals (but exactly 200 units larger) are used to identify these substantially identical components which operate in exactly the same manner as described above with reference to FIGS. 1, 2A, and 2B. Also, it should be understood that the extreme right-hand portion of machine 210 (not shown in FIG. 10) is substantially identical to pump 10 as shown in FIG. 1. Further, the operation of pistons 216, connecting rods 220, non-rotatable portion 222, and rotatable portion 224 of the split swash-plate and shuttle valve 256 are all the same as the operation of the similar parts of pump 10 as described above With reference to FIGS. 1, 2A, and 2B. Similarly, the operation of the servo mechanism for adjusting movable bearing 236 is the same as that described with reference to FIG. 5.

The primary difference between the embodiment illustrated in FIG. 10 and the pump embodiment already described above relates to (a) the substitution of a valve-plate to replace the exit valve units, and (b) the addition of a gimballed-yoke structure for supporting the nutatable-but-non-rotatable portion of the split swash-plate.

Figure 11:
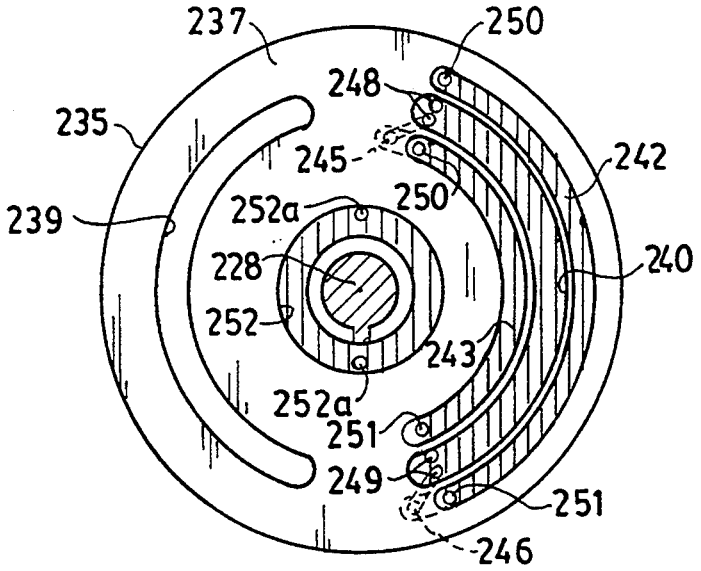
FIG. 11 is an end view of the valve-plate used in the machine shown in FIG. 10 taken along line 11—11.

A valve-plate 235 (also shown in an end view in FIG. 11), having respective first and second flat faces 237 and 238, is positioned between the base of housing 212 and an end cap 201 which is bolted to the housing by suitable means (not shown). End cap 201 has a cylindrical port 203 which is formed with radial dimensions to mate with the peanut-shaped end-ports 205, 205' that are formed in housing 212 at the base of each respective cylinder 218, 218'. Cylindrical port 203 opens into a variable fluid channel 207, the volume of channel 207 varying in the manner well known in the art to match the additive volumes of fluid being delivered to and from cylinders 218, 218' when the pump's swash-plate 222/224, is inclined to cause reciprocation of pistons 216, 216'.

Valve-plate 235 is splined to and rotates with slidable shaft 228 which is driven by drive element 230 in the manner explained above with reference to the pump embodiment disclosed in FIG. 1. As can best be seen in FIG. 11, flat face 237 of valve-plate 235 includes a large bean-shaped orifice 239 that connects with a fluid passageway completely through valve-plate 235 and which is positioned to mate with and pass between and over both cylindrical fluid—delivery port 203 of end cap 201 and cylinder end-ports 205, 205' as valve-plate 235 rotates with shaft 228. A second bean-shaped orifice 240, formed on the surface of flat face 237 in a position angularly opposite to orifice 239, has exactly the same radial and area dimensions as orifice 239. However, second orifice 240 is blocked to prevent the flow of fluid therethrough.

Valve-plate 235 is positioned on shaft 228 so that (a) whenever split swash-plate 222/224 is inclined from its 0° position in the direction shown in FIG. 10, open orifice 239 connects each respective cylinder 218, 218' with variable fluid channel 207 when the cylinder's respective piston 216, 216' is moving from right to left, and blocked orifice 240 prevents the passage of fluid between the cylinders and channel 207 when the pistons are moving from left to right; and so that (b) whenever split swash-plate 222/224 is inclined from its 0° position in the direction opposite to that shown in FIG. 10, the just-described connecting and blocking of the cylinders is reversed.

A second blocked orifice 241 (with a size, shape, and position in direct alignment with blocked orifice 240) is formed on opposite flat fade 238 of valve-plate 235, and means are provided for balancing pressures on both sides of valve-plate 235. Namely, two sets of shallow troughs 242, 243 and 245, 246 are formed on respective flat faces 237, 238. Each set of troughs straddles, respectively, one blocked orifice 240, 241; and each set has a combined surface area equivalent to the area of respective blocked orifice 240, 241 with which it is connected by means of respective pressure-balancing leakage paths 248, 249 and 250, 251 formed between flat faces 237 and 238. In this manner, fluid-pressure forces acting on blocked orifices 240, 241 are balanced on the opposite side of the valve-plate by the leakage of the same pressure to areas of identical size.

Also, valve-plate 235 has two further pressure-balancing shallow troughs 252, 252' formed on its opposite flat surfaces 237, 238 and connected by leakage paths **252*a*. Troughs 252, 252' are circumferential in shape, of equal combined surface area, and positioned near the inner circumference of valve-plate 235 which surrounds and is splined to shaft 228; and they are provided to balance any blowby pressures which may accumulate in the housing chambers that border these areas of valve-plate 235**.

In the machine embodiment disclosed in FIG. 10, the nutatable-but-non-rotatable portion 222 of the swash-plate is preferably supported in a gimballed-yoke structure that can best be seen in the schematic illustration of FIG. 12, since much of the structure has been omitted from FIG. 10 to permit viewing of other machine parts. An outer yoke 254 is mounted in a spherical bearing 253 for rotational movement about a first axis 255, and non-rotatable portion 222 of the split swash-plate is mounted in two bearings 257 carried by yoke 254 for rotation about a second axis 258. This just-described gimballed-yoke structure, which is bolted to housing 212 by spherical bearing 253, prevents the rotation of non-rotatable portion 222 about drive means axis 214 but permits its movement about the other two axes. Since the ends of articulated connecting rods 220, 220' are held against non-rotatable portion 222 in ball joints, this gimballed-yoke structure acts as a restraining means to prevent the collapse of the rods relative to the swash-plate under tangential forces related to relative rotation between the two portions of split swash-plate 222/224.

A pair of slots 259, 260, formed through housing 212, allows outer yoke 254 to rotate sufficiently about axis 255 for appropriate movement of swash-plate 222/224. Further, a sheet metal cover 261 is provided to encapsulate outer yoke 254 and contain oil splashing through slots 259, 260 from dry sump 298 during operation of the pump.

Figure 13:
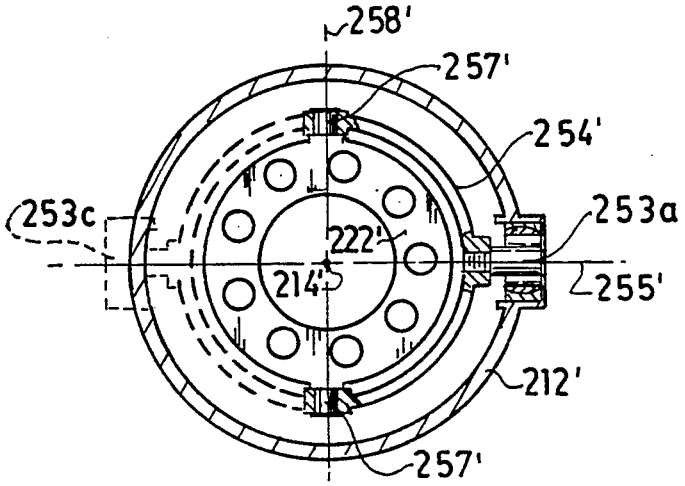
FIG. 13 is a schematic cross-sectional view similar to FIG. 12 but showing a different embodiment of the gimballed-yoke structure used to support the nutating-but-non-rotating portion of the split swash-plate of the machine shown in FIG. 10, the dotted lines showing a further modification appropriate for motor versions of the machine.

For use in lower horsepower hydraulic machines according to our invention, a further embodiment of the gimballed-yoke structure is schematically illustrated in FIG. 13. While this further embodiment is similarly attached to the machine's housing 212' by means of a spherical bearing **253*a* for rotational movement about a first axis 255' the outer yoke 254' is positioned completely within housing 212'. In this embodiment, non-rotatable portion 222' of the split swash-plate is similarly mounted in two bearings 257' carried by yoke 254' for rotation about a second axis 258'**, and this gimballed-yoke structure similarly prevents the rotation of non-rotatable portion 222′ about drive means axis 214′ while permitting its movement about the other two axes.

As discussed above, in some preferred embodiments of our hydraulic motors, the inclination of the split swash-plate is fixed at a maximum inclination (e.g., around 30°); and the relatively long moment arms about which the piston forces act on the nutating swash-plate also remain fixed. Thus, as explained above, when the inclination of the swash-plate of the related pump is reduced from its maximum 30°-position, the significantly increased fluid pressure being delivered to the motor continues to act against these relatively long moment arms. To support these larger forces, when the gimballed-yoke structures of FIGS. 12 and 13 are used in hydraulic motor units, they are modified as indicated in dotted lines. Namely, outer yokes 254 and 254′ are, respectively, formed as circles and are also attached to respective housings 212 and 212′ by means of trunnions held in respective second spherical bearings 253*b* and 253*c* to support the respective first axes 255 and 255′ at the maximum inclination in relation to central axis 214′. While the axes of these gimballed-yoke structures must remain orthogonal to each other and to their respective central axes 214, 214′ in planes radial to axes 214, 214′, their orientation relative to the housings can be adjusted as may seem appropriate for structural design purposes.

Referring now to FIGS. 14A, 14B, and 14C as well as FIG. 10, the swash-plate and externally-mounted outer yoke 254 of FIG. 12 are shown schematically in three different orientations representing those portions of hydraulic machine 210 adjusted for "maximum forward", "minimum", and "maximum reverse" operation, respectively, in response to appropriate positioning of bearing 236 and slideable shaft 228 by the servo mechanism, as explained above. In each FIG. 14, second axis 258 is shown in its median position when it is exactly aligned with T-bar pivot 234, this median position moving as adjustment of slideable shaft 228 carries T-bar pivot 234 from its furthest-right position in FIG. 14A to its furthest-left position in FIG. 14C. During nutation of split swash-plate 222/224, outer yoke 254 rotates about first axis 255 (see FIG. 12) to allow bearing 257 to move back and forth in slot 259 from each median position shown.

In FIGS. 15A and 15B, the swash-plate, drive shaft, T-bar pivot, and toggle-link portions of pump 210 are illustrated in respective partial views taken generally along lines 15A and 15B, respectively, in FIG. 10. A first face-plate 263, which is bolted to nutatable-but-not-rotatable portion 222 of the swash-plate, is used to retain the ball ends of the connecting rods in position against portion 222, the latter being mounted in the gimballed-yoke structure just described above. A second face-plate 265 is bolted to rotatable portion 224 of the swash-plate to securely fasten portion 224 to T-bar pivot 234 which is fixed to slideable shaft 228. Toggle-link 226, which is pivotally attached at its right end to drive element 230, is also pivotally attached by a pin 266 to swash-plate portion 224, and both portion 224 and shaft 228 rotate with drive element 230.

As was explained above, the pivotal connection between toggle-link 226 and the swash-plate's rotatable portion 224 is positioned as close as possible to axis 214 so that (i) main bearing unit 232 carries the major portion of the load exerted by the pistons on portion 224 and so that (ii) movable bearing 236 carries a substantially lesser portion of the load and can be readily adjusted by our relatively small and concentrically-located servo structure. As explained above, selective adjustment of slideable shaft 228, assisted by our servomechanism (see FIG. 5), is used to move T-bar pivot 234 from (a) its furthest-right position (as shown in FIG. 10) in which the swash-plate is in the "maximum forward" inclination; through (b) its median position in which the swash-plate is in the "minimum" inclination (i.e., where there is no appreciable movement of the connecting rods and their respective pistons); to (c) its furthest-left position in which the swash-plate is in the "maximum reverse" inclination.

In this regard, it can be seen that the pivotal connection between toggle-link 226 and swash-plate portion 224 is positioned just above shaft 228 when the swash-plate is in its maximum forward angular inclination. As T-bar pivot 234 is selectively adjusted to the left, toggle-link 226 rotates about its pivotal connection to drive element 230, and the bifurcated left end of toggle-link 226 moves downward and slightly to the right. When this movement occurs, interference between toggle-link 226 and shaft 228 is avoided by the following special structural design.

Integral with shaft 228, and immediately behind its connection with T-bar pivot 234, is a flattened section 267 that has a slotted area 267 formed along its upper surface. Flattened section 267 mates with the bifurcated left end of toggle-link 226, while slotted area 269 allows the central portion of pin 266 and the left end of toggle-link 226 to move downward during angular adjustment of the swash-plate.

Preferred Valve-Plate

FIG. 16 is a schematic illustration of still another embodiment of our hydraulic machine in which the valve means, for controlling both intake and exhaust of the operating fluid, comprises a further variation of our valve-plate. Again, most of the components of hydraulic machine 310 are similar or,identical to the components which make up the other embodiments described above, and similar reference numerals (but exactly 300 units larger than those used in FIG. 1) are used to identify these substantially identical components which operate in exactly the same manner as described above. For instance, the operation of pistons 316, connecting rods 320, and the split swash-plate's non-rotatable portion 322 and rotatable portion 324 are all the same as the operation of the similar parts of pump 10 as described above. Similarly, the operation of the servo mechanism for adjusting movable bearing 336 to position slideable shaft 328 and the T-bar pivot 334 to control the inclination of the swash-plate, is also the same.

The primary differences between the embodiment illustrated in FIG. 16 and the embodiments already described above relate to the modifications incorporated in (a) a new, disk-shaped valve-plate 335 and (b) the porting chambers in the end cap 301. Valve-plate 335 is shown enlarged and in greater detail in three views in FIGS. 17A, 17B, and 17C, FIGS. 17A and 17C being end views taken, respectively, along planes 17A—17A and 17C—17C in FIG. 16, and FIG. 17B being a cross-sectional view.

Valve-plate 335 has respective first and second flat faces 337 and 338 and is positioned between the base of housing 312 and end cap 30 which is bolted to the housing by suitable means (not shown). Valve-plate 335 is concentric with and splined to slidable shaft 328 which is rotatable with, and about the rotational axis of, drive element 330 in the manner explained above with reference to the embodiments disclosed in FIGS. 1 and 10.

As can best be seen in FIG. 17A, valve-plate 335 includes a first set of large bean-shaped orifices 339 and 340 that are positioned circumferentially and equiangularly on flat face 337. Bean-shaped orifices 339 and 340 are oriented angularly opposite to each other; both have exactly the same radial and area dimensions; and each is positioned to mate with and pass over peanut-shaped cylinder end-ports 305, 305′ as valve-plate 335 rotates with shaft 328. (As can be seen in FIG. 16, the radial-width dimension of orifices 339, 340 is equal to the radial-width dimension of end-ports 305, 305′.) Bean-shaped orifices 339 and 340 open, respectively, into respective fluid passageways that pass completely through valve-plate 335, terminating in a second set of similar bean-shaped orifices 339′ and 340′ on opposite flat face 338.

Orifices 339′ and 340′ have similar areas, but their respective radial dimensions are different from each other and different from the radial dimensions of orifices 339 and 340. Namely, orifice 339′ has larger radial dimensions than orifice 339, and orifice 340′ has smaller radial dimensions than orifice 340. Orifices 339′ and 340′ are positioned, respectively, to mate with and pass over respective cylindrical fluid-delivery ports 344 and 347 that are formed in the right end face of end cap 301, each passing over its respective cylindrical port as valve-plate 335 rotates with shaft 328.

Each cylindrical port 344, 347 opens into a respective fluid channel 344′, 347′ and the volume of each channel 344′, 347′ varies, in the manner well known in the art, to match the additive volumes of fluid being delivered to or from cylinders 318, 318′ when swash-plate 322/324 is inclined to allow reciprocation of pistons 316, 316′. Valve-plate 335 is positioned on shaft 328 so that orifice 339 connects each respective cylinder 318, 318′ with variable fluid channel 347′ whenever the cylinder's respective piston 316, 316′ is moving from right to left, and so that orifice 340 connects each respective cylinder 318, 318′ with variable fluid channel 344′ whenever the cylinder's respective piston 316, 316′ is moving from left to right. As can be seen in FIG. 16, cylindrical ports 344 and 347 are positioned about central axis 314 at respective different radial distances greater than and less than the radial positions of cylinder end-ports 305, 305′.

Flat faces 337 and 338 of valve-plate 335 also have several shallow troughs (i.e., blocked orifices) which are used for pressure-balancing purposes to permit valve-plate 335 to rotate readily when hydraulic machine 310 is operating and to prevent valve-plate 335 from becoming pressure bound when it is not operating so that its rotation can be readily initiated. This pressure-balancing feature can be most easily understood when hydraulic machine 310 is operating as a motor, its shaft 328 being rotated either clockwise or counterclockwise depending upon which cylindrical port 344 or 347 (in the right face of end cap 301) is delivering the high pressure fluid.

For instance, when shaft 328 is being driven in one direction, cylinders 318, 318′ of hydraulic machine (motor) 310 are receiving high pressure fluid through cylindrical port 344 and, upon the return stroke of their respective pistons 316, 316′, fluid exits from the cylinders through cylindrical port 347. Under these conditions, high pressure fluid flows into cylinders 318, 318′ only from those areas of cylindrical port 344 that are aligned with rotating bean-shaped orifice 339′, while the remaining area of port 344 is blocked by the flat face 338 of valve-plate 335. Therefore, that blocking portion of flat face 338 which passes over port 347 is subjected to the full pressure of the high pressure fluid being delivered to motor 310.

To overcome the unbalancing effect of this pressure on flat face 338 from the blocked area of port 344, a shallow trough 342 is formed on opposite flat face 337, and pressure-balancing leakage paths 348 are formed between respective flat faces 337, 338. In this preferred embodiment, although trough 342 is positioned a little closer to the outer circumference of valve-plate 335 than bean-shaped orifice 339′, it is designed (a) to be at approximately the same radial distance as cylindrical fluid-delivery port 344 from the rotational axis of shaft 328, and (b) to have a combined surface area equivalent to the area of that portion of flat face 338 that blocks cylindrical port 344. In this manner, fluid pressure passes through leakage paths 348 to allow equal pressure to act against equivalent areas on each face 337, 338 of valve-plate 335.

Similar balancing means are provided when shaft 328 of motor 310 is being driven in the opposite direction by receiving high pressure fluid through cylindrical port 347 and by having the fluid exit from the cylinders through cylindrical port 344. Under these conditions, high pressure fluid flows into cylinders 318, 318′ only from those areas of cylindrical port 347 that are aligned with rotating bean-shaped orifice 340′, while the remaining area of port 347 is blocked by the flat face 338 of valve-plate 335. Therefore, that portion of flat face 338 which passes over port 347 is subjected to the full pressure of the high pressure fluid being delivered to motor 310.

Once again, to overcome the unbalancing effect of this pressure on flat face 338 from the blocked area of port 347, a shallow trough 343 is formed on opposite flat face 337, and leakage paths 349 are formed between respective flat faces 337, 338. Trough 343 is positioned at approximately the same radial distance from the axis of valve-plate 335 as bean-shaped orifice 340′, and it has a combined surface area equivalent to the area of that portion of flat face 338 that blocks cylindrical port 347. In a manner similar to that just described above, fluid pressure passes through leakage paths 349 to allow equal pressure to act against equivalent areas on each flat face 337, 338, thereby balancing the pressures being exerted on valve-plate 335.

As explained above, bean-shaped orifices 339 and 340 on flat face 337 are positioned to pass over the peanut-shaped cylinder end-ports 305, 305′ (FIG. 16) at the bottom end of each cylinder 318, 318′. Cylinder end-ports 305, 305′ have the same predetermined shape and area; and to separate the high and low pressure fluids being delivered to and from the cylinders, bean-shaped orifices 339 and 340 are separated from each other at each of their respective ends by a portion of the surface of flat face 337, each of these separating portions being slightly larger than the predetermined area of each cylinder end-port 305, 305′. Each respective piston 316, 316′ reverses direction, changing from its pressure stroke to its fill or exhaust stroke, during the interval when these separating portions of face 337 are passing over its respective end-port 305, 305′.

For instance, when hydraulic machine 310 is acting as a pump, the pressure cycle of each piston 316, 316′ has already begun at the time the leading end of either bean-shaped orifice 339 or 340 (depending on the direction of rotation of drive means 330 and shaft 328) begins its pass over port 305, 305', and the pressure cycle is not quite finished at the moment when the trailing end of the same orifice completes its pass over end-port 305, 305'. Therefore, during this moment, pressurized fluid in cylinder 318, 318' is blocked by the separating portions of flat face 337, and even this momentary pressure can affect the balance of valve-plate 335.

To overcome this momentary imbalance, two pairs of shallow troughs 345 and 346 are formed on flat face 338 and connected to the respective separating areas of flat face 337 by respective leakage paths 350 and 351. The combined areas of each pair of pressure-balancing troughs 345, 346 are equal to the predetermined area of each port 305, 305'. Of course, if the valve-plate is to be used with a non-reversible pump (i.e., a pump that only rotates in one direction), only one pair of troughs—either pair 345 or 346—is required.

Also, in a manner similar to that discussed above in relation to the valve-plate incorporated in the embodiment of the invention illustrated in FIG. 10, the preferred embodiment of valve-plate 335 includes one further pair of balancing troughs, namely, shallow troughs 378, 379 that are circumferentially shaped and connected by leakage paths 380. Troughs 378, 379 balance any pressure differences appearing near shaft 328 as the result of blowby.

Self-Lubrication System

As indicated in the above discussion of the invention's use of a dry sump, operating fluid is also used for lubrication purposes in preferred embodiments. While some lubrication is provided by blowby, critical bearings are also serviced by fluid pressurized by the pump's pistons and delivered through small channels in the housing, shaft, connecting rods, etc. In the motor embodiment described above (FIG. 6), a small gear pump is used to supply operating fluid from the dry sump to its small lubricating channels.

In a further self-lubrication system illustrated in FIGS. 15A, 16, and 18, small channels 370, 370', 470 receive the required lubricating fluid in a manner well known in the art, namely, from the high pressure side of the machine's operating fluid system, the fluid being delivered to these channels through one-way valves (not shown). Following its use for lubrication purposes, this small amount of fluid then leaks into the dry sump, from which it is returned to the reservoir, e.g., in the manner explained above with reference to FIG. 8.

In the embodiments of our hydraulic machine illustrated in FIGS. 15A, 16, and 18, the roller bearings used between the split portions of the swash-plate (e.g., as in FIGS. 1 and 6) have been replaced with bearing-plates separated by a fluid film bearing of lubrication fluid delivered through channel 370 in shaft 328 and channel 370' in T-bar pivot 334 (the latter being identified with numeral 234 in FIG. 15A).

However, this just-described lubricating system is not appropriate for hydraulic machines that are used in power trains in which hydraulic operation is intermittent, e.g., when incorporated in a vehicle drive system that only uses a hydraulic pump/motor combination for acceleration, changing to direct mechanical drive for 1:1 operation at highway speeds. That is, when the hydraulic system is not operating, its fluid is not pressurized by the pump's pistons, since the swash-plate is in its 0° position of minimum inclination so that the pistons do not reciprocate in response to the rotation of the drive element.

We overcome this just-described self-lubricating problem with the special apparatus illustrated in FIG. 18, which can provide a small amount of high pressure fluid for lubricating purposes when our hydraulic machines are being driven but are not hydraulically operating. While this apparatus is shown incorporated in a further embodiment similar to that of FIG. 16, it can be added as well to any embodiment of our hydraulic machine. Once again, most of the components of this furthers hydraulic machine 410 are similar or identical to the components which make up the other embodiments described above, and similar reference numerals (but exactly 400 units larger than those in FIG. 1) are used to identify these substantially identical components which operate in exactly the same manner as described above.

In this further embodiment, the housing of machine 410 comprises three separate elements, namely, end cap **412*a*, cylinder block 412*b*, and main bearing cap 412*c*. End cap 412*a* is similar to end cap 301 of machine 310 (FIG. 16); and main bearing cap 412*c* is similar to the right-hand portion of its housing 312, carrying both the main bearing supporting the drive element 430 and a spherical bearing 453 for restraining rotation of non-rotating portion 422 of the split swash-plate. Main bearing cap 412*c* also forms the dry sump 498 in which the swash-plate is mounted; and cylinder housing 412*b* is formed with the fixed cylinders 418 that carry the pistons 416; and it also supports the slideable shaft 428 in a movable bearing 436**.

While main bearing cap **412*c* is bolted directly to cylinder housing 412*b*, an annular spacer 472 separates cylinder housing 412*b* from end cap 412*a*, providing an appropriate spacing to receive the disk-shaped valve-plate 435 that is keyed to shaft 428**.

Referring now to our improved self-lubricating system, an annular slot 474, formed around the outside of movable bearing 436, cooperates with a spring-loaded ball detent 476 that is positioned between two of the cylinders in housing **412*b*. Detent 476 is designed to fall into slot 474 when movable bearing 436, shaft 428, and the T-bar pivot 434 are positioned so that swash-plate 422/424 is slightly less than 1° from its 0° inclination. While this very slight inclination does not add appreciably to the load imposed on the engine rotating drive element 430, it does permit a very slight reciprocation of pistons 416; and this minimal piston movement maintains sufficient fluid pressure in cylinders 418 and the high pressure port 447 so that, coupled with the atmospheric pressure maintained in dry sump 498, operating fluid continues to be drawn past the one-way valves (not shown) into the small channels 470** to provide appropriate lubrication for the fluid film bearing separating the split portions of the swash-plate and for other bearing surfaces as well.

The spring bias on ball detent 476 maintains the swash-plate in this slightly-inclined position whenever the servo mechanism moves movable bearing 436 to adjust the swash-plate to its "minimum" inclination. However, the bias on detent 476 is readily overcome by the servo mechanism whenever it is desired to adjust the swash-plate to any other inclination.

Radial Valve System

In still another preferred embodiment, disk-shaped valve-plate 335 (described above and shown in FIGS. 16 and 17) is replaced with a radial-valve system. To simplify the explanation of this further embodiment, it shall be described as being incorporated in hydraulic machine 310. That is, it shall be assumed that (with reference to FIGS. 16 and 17) valve-plate 335 is replaced by the apparatus illustrated in FIGS. 19 and 20, while the other elements of hydraulic machine 310 remain exactly as shown in FIG. 16.

Therefore, it shall be assumed that the apparatus shown schematically in FIGS. 19 and 20 uses the same housing 312, with its respective cylinder end-ports 305, 305' circumferentially positioned around drive means axis 314 and shaft 328, and that it is held in place by the same housing end cap 301, the latter including respective cylindrical fluid-delivery ports 344 and 347 formed in its right end face concentric with axis 314, each of these cylindrical ports opening into a respective channel 344', 347'.

Referring now to FIGS. 19 and 20, the replacement for disk-shaped valve-plate 335 (of FIG. 16) is a disk-shaped radial-valve insert 420 which supports a plurality of valves in respective channels 421*a–i* arranged radially about drive axis 314 and shaft 328. in the specific embodiment illustrated, each valve has a cylindrical spool-type form with a narrowed central section 422*a–i* fixed to a respective inner end 424*a–i* and outer end 426*a–i*; and each valve is supported in its respective radial channel 421*a–i* for movement between two end positions, namely, a retracted position and an extended position. Valve 522*a* is shown in its fully-retracted position, while valve 422*e* is shown fully-extended.

Each valve is biased toward its fully-retracted position by a respective spring 432*a*, 432*e*, one end of which is received within a cylindrical bore in the valve's outer end 426*a*, 426*e* (the springs are omitted in FIG. 19). The opposite end of each spring 432*a*, 432*e* is positioned in a bore formed in the surface of a channel plug 433*a*, 433*e* that appropriately seals the outer end of each channel 421*a–i*, being fixed in place by a respective snap ring.

Each valve is held against its respective spring by a cam 434 keyed to shaft 328, cam 434 riding against each valve's respective inner end 424*a–i*. Each valve is moved to its fully-extended position by the highest point on cam 434 and is moved back to its fully-retracted position by its spring 432*a*, 432*e* as its inner end rides on the lowest portion of cam 434.

As can be seen in FIG. 20, throughout each valve's reciprocating motion between its retracted and extended positions, its central section 422*a*, 422*e* remains in general alignment with the respective end-port 305, 305' of its associated cylinder 318, 318'. Adjacent to each valve, and aligned with its central section 422*a*, 422*e*, is an orifice 430*a*, 430*e* formed through the right-hand face of disk-shaped insert 420 for connecting each radial channel 421*a*, 421*e* with its related cylinder end-port 305, 305'. Similarly, associated with each valves a further pair of orifices 436*a*, 436*e* and 438*a*, 438*e* formed in the left-hand face of insert 420. Outer orifices 436*a*, 436*e* are aligned with outer cylindrical fluid-delivery port 344 in end cap 301, while inner orifices 438*a*, 438*e* are aligned with inner cylindrical fluid-delivery port 347, connecting these ports with each respective radial channel 421*a*, 421*e*.

When each valve is in its retracted position, its outer end 426*a* blocks outer orifice 436*a*, while inner orifice 438*a* is open, forming a fluid passage from fluid-delivery channel 347' through radial channel 421*a* to cylinder 318. When each valve is in its extended position, its inner end 424*e* blocks inner orifice 438*e*, while outer orifice 436*e* is open, forming a fluid passage from fluid-delivery channel 344' through radial channel 421*e* to cylinder 318'.

Cam 434 is keyed to shaft 328 so that (a) each respective valve blocks the connection to fluid-delivery channel 344' while permitting fluid to flow between fluid delivery channel 347' and its respective cylinder 318, 318' whenever the cylinder's respective piston 316, 316' (FIG. 16) is moving from right to left, and so that (b) each respective valve blocks the connection to fluid-delivery channel 347' while permitting fluid to flow between fluid-delivery channel 344' and its respective cylinder 318, 318' whenever the cylinder's respective piston 316, 316' is moving from left to right.

Disk-shaped radial-valve insert 420, like valve-plate 335 of FIG. 16, permits hydraulic machine 310 to be operated in either direction. That is, the just-described radial-valve apparatus is not dependent upon any predetermined direction of fluid flow but rather can readily control the flow of high-pressure fluid to or from each cylinder 318, 318' from or to either fluid-delivery channel 344', 347' so that, with this valving arrangement, hydraulic machine 310 can be used as a hydraulic motor driven by a reversible hydraulic pump, or it can be used as a hydraulic pump that can be driven by an engine rotating in either direction.

Hydraulic Pump and Motor as a Vehicle Drive

The advantages of our invention, particularly its hydrodynamic capabilities, can be specially utilized when our pump and motor are combined and incorporated in an automotive vehicle drive. As shown schematically in the block diagram of FIG. 21, our hydraulic machine is capable of functioning per se as an automotive transmission-type drive for lighter vehicles, i.e., without requiring the further assistance of gearing to accelerate the vehicle from a dead stop to highway speeds.

Our hydraulic pump 510 and motor 512 are each arranged according to one or more of the above-described embodiments and are combined in the manner shown in FIG. 8. As is well known in the automotive drive art, the vehicle's power source, an engine 514, is designed to provide a desired horsepower output when rotating a drive shaft at an optimum speed appropriate for driving the vehicle at highway speeds.

The vehicle's engine 514 drives the input shaft of pump 510 which, in turn, results in the rotation of the output shaft of motor 512 at a speed that varies with the angular adjustment of the swash-plate of one or the other of the hydraulic machines. (As indicated earlier, in preferred embodiments, the swash-plate of pump 510 is arranged to be fully adjustable, e.g., from −30° through +30°, as discussed with reference to the embodiments shown in FIGS. 10–15; and the swash-plate of motor 52 is fixed at a maximum angle of about 30°.)

Rotation of the output shaft of motor 512 begins slowly at startup as a speed control 516 moves the swash-plate of pump 510 from its 0° position toward its +30° angular adjustment. As noted above, our hydraulic machines are capable of operating under significantly higher pressures than known commercially-available pumps/motors of similar size, weight, and speed specifications. Therefore, during the initial slow speeds of this startup, pump 510 and motor 512 are able to deliver the full horsepower of engine 514 to the vehicle drive 518. When vehicle drive 518 has been accelerated up to a desired highway speed, a bypass clutch preferably disconnects engine 514 from pump 510 and connects it directly to vehicle drive 518. (Such a clutch arrangement is shown in our Hydromechanical Orbital Transmission as disclosed in PCT International Application No. PCT/US90/01407 published 20 Sep. 1990 as International Publication No. WO 90/10807.)

However, it should be noted that bypass clutch 520 may be omitted from the just-disclosed embodiment without causing any significantly large loss in operating efficiency. This is possible because, as explained above, (a) the cylinders of our hydraulic machines do not rotate; (b) none of their rotating elements is heavily spring-loaded, i.e., to reduce blowby; and(c) their rotating shafts and swash-plates operate in dry sumps, thereby minimizing efficiency losses which normally accompany the operation of prior art hydraulic apparatus presently available for automotive use.

It will be appreciated that the advantages of our invention can be achieved by many different arrangements of the various embodiments of our hydraulic machine which can include multiple possible combinations of the elements that have been disclosed in several forms, e.g. the various gimballed supports for the non-rotating portion of the swash-plate, one or more of the valve systems for controlling the flow of fluid to and from the cylinders, the preferred arrangements of our pump/motor in a common housing, etc.

We claim:

1. In a hydraulic machine having:

a plurality of pistons reciprocative in respective fixed cylinders positioned in a housing circumferentially about a central axis aligned with a drive element supported in said housing by a main bearing, the stroke of said pistons being determined by the inclination of a split swash-plate about a pivot;

valve means associated with each cylinder for opening and closing respective fluid passages in said housing permitting the flow of fluid to and from said cylinders; and said swash-plate being split into a nutatable-but-non-rotatable portion for holding a first end of each of a plurality of connecting rods, the other end of each connecting rod being held by a respective one of said pistons, and a nutatable-and-rotatable portion connected to said drive element for movement about said pivot and said central axis;

the improvement comprising:

restraining means for limiting the motion of at least one of said connecting rods to one plane relative to its respective piston to maintain said connecting rods in alignment about said drive means axis, said restraining means being one of:

a slotted end cap for at least one of said pistons for restraining its respective connecting rod to motion in one plane relative to said piston; and gimbal means for supporting said nutatable-but-non-rotatable portion of said split swash-plate, said gimbal means having (a) a first bearing in which said non-rotatable portion is mounted for movement about a first axis, said first bearing being carried on (b) a yoke mounted for movement about a second axis perpendicular to said first axis, said yoke being secured to said housing by a single second bearing.

2. The hydraulic machine of claim 1 further comprising:

said main bearing for supporting said drive element being located at one end of said housing;

said pivot being supported in a movable bearing for adjusting its relative position along said central axis;

a control rod adjustable by a positioning stem, said control rod being aligned concentric with said central axis and being connected to said movable bearing, and the movement of the positioning stem being used for controlling the location of said control rod and said pivot and, thereby, the inclination of said swash-plate;

said housing including a dry sump section in which are located said pivot, said swash-plate, and said connecting rods; and the adjustment of said control rod moving said movable bearing and said pivot to any one of a plurality of locations between a first location where said swash-plate is at a minimum inclination and a final location where said swash-plate is at a maximum inclination.

3. The hydraulic machine of claim 2 wherein said nutatable-and-rotatable portion of said swash-plate is supported by said main bearing through said movable bearing and a pivotable toggle-link that is also pivotably connected to said drive element, the connection between the swash-plate's rotating portion and the toggle-link being positioned at a location near said central axis selected so that substantially all of the axial forces acting on said swash-plate are carried by said main bearing through said toggle-link and by said movable bearing through said pivot and so that a significantly larger percentage of said forces are borne by said main bearing rather than by said movable bearing.

4. The hydraulic machine of claim 2 wherein further passageways are formed in said housing and said drive element for delivering pressurized fluid to bearings and to said split swash-plate for lubrication, said further passageways being connected with said respective fluid passages permitting the flow of fluid to and from said cylinders; and when said pivot is moved to said first location, said swash-plate is positioned at slightly less than 1° from its said minimum inclination so that said pistons reciprocate very slightly to produce a predetermined minimal flow of fluid through said further passageways for lubrication purposes.

5. The hydraulic machine of claim 2 wherein said control rod comprises a hydraulically-assisted servo mechanism.

6. The hydraulic machine of claim 2 wherein said main bearing comprises a removable cartridge so that the design thereof may be varied and interchanged to match the desired horsepower and rotational speeds of the machine.

7. The hydraulic machine of claim 2 wherein said housing is cylindrical in form and said entire machine, except for one end of said drive element and the positioning stem, is located within said housing.

8. The hydraulic machine of claim 2 wherein said valve means comprises a rotatable valve-plate having a plurality of shaped orifices, said plate being rotatable with said drive element.

9. The hydraulic machine of claim 2 wherein said split swash-plate is adjustable about said pivot means between two positions of maximum inclination, the first position of maximum inclination being inclined to said position of minimum inclination in a first direction and the second position being inclined to said position of minimum inclination in a direction opposite to said first direction.

10. A pair of hydraulic machines according to claim 2 wherein:

one of said machines comprises a hydraulic pump; and the other of said machines comprises a hydraulic motor in which said split swash-plate is fixed at said maximum inclination in which said pistons reciprocate through a maximum stroke, said shaft and pivot means are not movable, said control rod is removed, and the drive element of said hydraulic motor rotates with the rotating portion of the swash-plate when the latter is nutated by the reciprocation of the motor's pistons in response to fluid received from said hydraulic pump.

11. The pair of hydraulic machines according to claim 10 wherein the housings for said pump and said motor are each primarily cylindrical in exterior shape, said housings having structural portions joined together to form a single, combined unit with fluid passageways formed integrally therein for transferring fluid from one housing to the other.

12. The pair of hydraulic machines according to claim 10 further comprising a casing containing a fluid reservoir and wherein the housings for said pair are mounted side-by-side within said reservoir.

13. The pair of hydraulic machines according to claim 12 wherein said housings are joined together and have structural portions with fluid passageways formed integrally therein for transferring fluid between said housings and said reservoir.

14. A split swash-plate for a hydraulic machine having a housing, a plurality of pistons reciprocatively mounted in cylinders fixed in said housing and positioned circumferentially about the rotational axis of a drive element supported in said housing by a main bearing, said swash-plate comprising:

a nutatable-but-non-rotatable portion and a nutatable-and-rotatable portion, said pistons being connected to said nutatable-but-non-rotatable portion by respective rods;

said nutatable-and-rotatable portion being connected to said drive element for rotation therewith; and gimbal means attached to said nutatable-but-non-rotatable portion, said gimbal means having (a) a first bearing on which said non-rotatable portion is mounted for rotation about a first axis and (b) a yoke on which said first bearing is mounted for rotation about a second axis perpendicular to said first axis, said yoke being secured to said housing by a single bearing.

15. The split swatch-plate of claim 14 wherein said single bearing is a spherical bearing.

16. The split swash-plate of claim 15 wherein said yoke is positioned interior of said housing.

17. The split swash-plate of claim 14 wherein said yoke is secured to said housing at a predetermined fixed angle to the rotational axis of said drive element.

18. The split swash-plate of claim 17 wherein said yoke comprises a circular band positioned exterior to said housing, and said single bearing is fixed to said housing by two trunnions.

19. The split swash-plate of claim 14 wherein said yoke is positioned exterior of said housing.

20. The split swash-plate of claim 14 wherein said rotatable portion of the swash-plate is connected to said drive element by a toggle-link having one end eccentrically attached to said drive element and its other end attached to said rotatable portion of the swash-plate at a location near the axis of said drive element.

21. A lubricating system for a hydraulic machine having:

a housing with passageways formed therein for delivering pressurized and unpressurized fluid to and from a plurality of pistons reciprocatively mounted in cylinders fixed in said housing and positioned circumferentially about the rotational axis of a drive means supported in bearings;

each said cylinder having a piston reciprocatively mounted therein, the reciprocative stroke of said pistons causing pressurization and flow of said fluid in a volume which varies in accordance with the inclination of a swash-plate split into a nutatable-but-non-rotatable portion and a nutatable-and-rotatable portion;

said pistons being connected to said nutatable-but-non-rotatable portion by respective rods, and said swash-plate being movable to any one of a plurality of locations between (a) a first location where said swash-plate is at a minimum inclination and (b) a final location where said swash-plate is at a maximum inclination;

said system comprising:

further passageways formed in said housing and said drive means and cornered with said passageways for pressurized fluid for delivering said pressurized fluid to said bearings and to said split swash-plate for lubrication; and means for controlling the inclination of said swash-plate when positioned in said first location so that said pistons continue to reciprocate very slightly through a stroke sufficient to generate a predetermined minimal flow of fluid under pressure.

22. In a valve-plate system for a hydraulic machine having a housing with a plurality of fluid-delivery ports formed therein for delivering pressurized fluids, a rotatable drive means, and a plurality of cylinders mounted in said housing with end-ports positioned circumferentially at a first radial distance about a rotational axis, said end-ports having a predetermined radial-width dimension, and said system controlling the flow of fluid between said cylinders and said fluid-delivery ports, the improvement comprising:

two of said fluid-delivery ports being cylindrically-shaped openings positioned about said rotational axis at respective different radial distances greater than and less than said first radial distance;

a disk-shaped valve-plate with two flat faces, a first one of said flat faces being positioned against said end-ports of said cylinders and the second of said flat faces being positioned against said cylindrically-shaped openings of said housing, and said valve-plate being concentric with said rotational axis and rotatable with said drive means;

a first set of orifices formed on said first one of said flat faces and having areas of predetermined size and shape, said orifices being positioned in radial alignment with said cylinder end-ports and having radial-width dimensions equal to said radial-width dimensions of said end-ports;

a second set of orifices formed on the second of said flat faces and having areas of the same predetermined size as said first set, of orifices, said second set of orifices being positioned, respectively, in radial alignment with respective ones of said two cylindrically-shaped fluid-delivery ports, the orifices of said first and second sets being connected to form at least two straight fluid passageways passing directly and without change in direction completely through said valve-plate so that, even though said two fluid passageways interconnect orifices positioned respectively at different radial distances from said rotational axis, each said connecting fluid passageway passes straight through said valve-plate disk to allow said fluid to move through said disk unimpeded by any change in directional flow; and trough means formed on said rotatable disk-shaped valve-plate for balancing the pressure acting on said rotatable valve-plate When an area on one of said flat faces is blocking pressurized fluid being delivered through one of a fluid-delivery port and a cylinder end-port, said trough means including:

at least one shallow trough formed on one of said flat faces and at least one pressure-balancing leakage path between said trough and said area of said flat face blocking said pressurized fluid, and said trough having a combined area equivalent to the area of said flat face blocking said pressurized fluid.

23. The valve-plate system of claim 22 wherein said trough means includes:

first and second shallow troughs formed on said first flat face and connected, respectively, by at least one pressure-balancing leakage path to respective first and second areas on said second flat face blocking pressurized fluid being delivered, respectively, through said two cylindrically-shaped fluid-delivery ports; and said first and second shallow troughs are positioned, respectively, at substantially the same radial distance from said rotational axis as said two cylindrically-shaped fluid-delivery ports.

24. The valve-plate system of claim 22 wherein:

said cylinder end-ports each have a similar predetermined shape and area; and said first set of orifices positioned in radial alignment with said end-ports includes two orifices positioned equiangularly and opposite to each other on said first float face, said two orifices being separated from each other at each of their ends by portions of said first flat face, each said separating portion having an area slightly larger than said predetermined area of each said end-port;

said system further comprising:

a further set of at least one pair of shallow troughs formed on said second flat face, each trough in said pair being connected by at least one pressure-balancing leakage path to a respective one of said separating portions; and each said pair of troughs in said further set having a combined area equivalent to the area of each said cylinder end.

25. The valve-plate system of claim 24 wherein said further set of shallow troughs includes two pair of troughs.

26. The valve-plate system of claim 22 wherein:

said drive means includes a drive shaft concentric with said rotational axis;

said valve-plate has an inner circumference surrounding and splined to said drive shaft; and said trough means further comprises a pair of circumferential shallow troughs, each with a combined surface area equivalent to the other and each formed respectively on an opposite one of said flat faces in proximity to said inner circumference, said pair of circumferential troughs being interconnected by at least one pressure-balancing leakage path.

* * * * *